US007958687B2

(12) United States Patent
Dilorenzo

(10) Patent No.: US 7,958,687 B2
(45) **Date of Patent: *Jun. 14, 2011**

(54) CONCRETE PANEL CONSTRUCTION SYSTEM

(75) Inventor: Nick Dilorenzo, Woodbridge (CA)

(73) Assignee: Brentmuir Developments (1993) Limited, Weston, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 12/422,397

(22) Filed: Apr. 13, 2009

(65) Prior Publication Data

US 2009/0193733 A1 Aug. 6, 2009

Related U.S. Application Data

(60) Division of application No. 11/389,316, filed on Mar. 27, 2006, now Pat. No. 7,523,591, which is a continuation of application No. 10/752,583, filed on Jan. 8, 2004, now Pat. No. 7,017,316, which is a continuation of application No. 09/705,788, filed on Nov. 6, 2000, now Pat. No. 6,698,150, which is a continuation of application No. PCT/CA00/00697, filed on Jun. 9, 2000, and a continuation-in-part of application No. 09/328,901, filed on Jun. 9, 1999, now Pat. No. 6,260,320.

(30) Foreign Application Priority Data

Jun. 9, 1998 (CA) ..... 2240098
Jun. 9, 1999 (CA) ..... 2274287

(51) Int. Cl.
*E04B 1/20* (2006.01)

(52) U.S. Cl. ..... 52/319; 52/414; 52/250

(58) Field of Classification Search ..... 52/414, 52/250, 251, 144, 602, 319
See application file for complete search history.

(56) References Cited

U.S. PATENT DOCUMENTS 2,043,697 A 6/1936 Deichmann
(Continued)

FOREIGN PATENT DOCUMENTS

CA 2078381 9/1992
(Continued)

OTHER PUBLICATIONS

Sekisui House Ltd., English Abstract of JP 10252278.
(Continued)

*Primary Examiner* — Basil Katcheves
(74) *Attorney, Agent, or Firm* — Scott Pundsack; Borden Ladner Gervais LLP

(57) ABSTRACT

A concrete building panel has a slab and a plurality of ribs and beams. A series of horizontal holes in the end ribs are spaced at a selected constant spacing such that adjacent panels may be fastened together through them. In one type of panel, the slab is separated from the ribs to provide an air gap. Connections between holes in two adjacent concrete wall panels are made by a hollow conduit having an abutment at either end to engage the concrete wall panels. Other connections between adjacent panels involve a stitch with legs which extend through holes in the beams. Other connections involve a space made by vertical channels of horizontally adjacent panels. A plate fitted into the space aligns the adjacent panels and may extend upwards to align upper panels. Load bearing horizontal holes through the ribs are reinforced with reinforcing bar in the concrete arranged in generally triangular shapes. The concrete panels are formed in a form with subforms aligned by rods which create horizontal holes of the desired size and placement when removed.

17 Claims, 25 Drawing Sheets

U.S. PATENT DOCUMENTS

| | | | | |
|---|---|---|---|---|
| 2,202,745 | A | | 5/1940 | Muse |
| RE021,905 | E | | 9/1941 | Nielsen |
| 2,262,899 | A | | 11/1941 | Mechlin |
| 2,270,846 | A | * | 1/1942 | Hines ..... 52/223.7 |
| 2,321,813 | A | | 6/1943 | Henzel |
| 2,515,977 | A | | 7/1950 | Banneyer |
| 3,232,018 | A | | 2/1966 | MacKean |
| 3,281,510 | A | | 10/1966 | Lovret |
| 3,475,529 | A | | 10/1969 | Lacy |
| 3,683,578 | A | | 8/1972 | Zimmerman |
| 3,885,369 | A | | 5/1975 | Ott |
| 3,959,940 | A | | 6/1976 | Ramberg |
| 3,979,863 | A | * | 9/1976 | Hurley et al. ..... 52/92.1 |
| 4,019,293 | A | | 4/1977 | Armas |
| 4,030,262 | A | | 6/1977 | Dean |
| 4,112,646 | A | | 9/1978 | Clelland |
| 4,157,640 | A | | 6/1979 | Joannes |
| 4,178,343 | A | | 12/1979 | Rojo, Jr. |
| 4,182,092 | A | | 1/1980 | Weaver |
| 4,211,043 | A | | 7/1980 | Coday |
| 4,219,978 | A | | 9/1980 | Brown |
| 4,290,246 | A | * | 9/1981 | Hilsey ..... 52/169.1 |
| 4,320,606 | A | | 3/1982 | GangaRao |
| 4,336,676 | A | | 6/1982 | Artzer |
| 4,454,702 | A | | 6/1984 | Bonilla-Lugo et al. |
| 4,530,191 | A | | 7/1985 | Boisbluche |
| 4,554,124 | A | | 11/1985 | Sudrabin |
| 4,570,398 | A | | 2/1986 | Zimmerman |
| 4,605,529 | A | | 8/1986 | Zimmerman |
| 4,611,450 | A | | 9/1986 | Chen |
| 4,614,013 | A | | 9/1986 | Stevenson |
| 4,669,240 | A | | 6/1987 | Amormino |
| 4,731,915 | A | | 3/1988 | Holder |
| 4,751,803 | A | | 6/1988 | Zimmerman |
| 4,759,160 | A | | 7/1988 | Fischer |
| 4,781,006 | A | | 11/1988 | Haynes |
| 4,901,491 | A | | 2/1990 | Phillips |
| 4,934,121 | A | | 6/1990 | Zimmerman |
| 4,998,393 | A | | 3/1991 | Baena |
| 5,055,252 | A | | 10/1991 | Zimmerman |
| 5,058,345 | A | | 10/1991 | Martinez |
| 5,183,616 | A | | 2/1993 | Hedrick |
| 5,222,338 | A | | 6/1993 | Hull et al. |
| 5,317,848 | A | | 6/1994 | Abbey |
| 5,335,472 | A | | 8/1994 | Phillips |
| 5,381,635 | A | | 1/1995 | Sanger |
| 5,398,470 | A | | 3/1995 | Ritter et al. |
| 5,493,838 | A | | 2/1996 | Ross |
| 5,501,055 | A | | 3/1996 | Storch et al. |
| 5,566,520 | A | | 10/1996 | Branitzky |
| 5,656,194 | A | | 8/1997 | Zimmerman |
| 5,885,001 | A | | 3/1999 | Thomas |
| 5,950,390 | A | | 9/1999 | Jones |
| 5,953,864 | A | | 9/1999 | Beck |
| 6,003,278 | A | | 12/1999 | Weaver et al. |
| 6,112,498 | A | | 9/2000 | Zweig |
| 6,151,843 | A | | 11/2000 | Weaver et al. |
| 6,260,320 | B1 | | 7/2001 | Di Lorenzo |
| 6,338,231 | B1 | | 1/2002 | Enriquez |
| 6,401,417 | B1 | | 6/2002 | Leblang |
| 6,427,406 | B1 | | 8/2002 | Weaver et al. |
| 6,463,702 | B1 | | 10/2002 | Weaver et al. |
| 6,698,150 | B1 | | 3/2004 | DiLorenzo |
| 7,017,316 | B2 | | 3/2006 | DiLorenzo |

FOREIGN PATENT DOCUMENTS

| | | |
|---|---|---|
| DE | 2017109 | 11/1970 |
| DE | 2254174 | 5/1974 |
| DE | 2951898 | 7/1980 |
| DE | 3413305 | 10/1984 |
| EP | 0818287 | 1/1998 |
| FR | 483834 | 5/1917 |
| FR | 863026 | 3/1931 |
| FR | 898765 | 7/1944 |
| FR | 1422473 | 3/1966 |
| FR | 2045625 | 3/1971 |
| FR | 2560621 | 9/1985 |
| GB | 1119057 | 11/1965 |
| JP | 10252278 | 9/1998 |

OTHER PUBLICATIONS

Weaver Precast & Florida, Inc., "Epic Wall System".

* cited by examiner

CONCRETE PANEL CONSTRUCTION SYSTEM

This application is a divisional of U.S. application Ser. No. 11/389,316, filed Mar. 27, 2006, which is a continuation of U.S. application Ser. No. 10/752,583, filed Jan. 8, 2004, issued as U.S. Pat. No. 7,017,316, which is a continuation of U.S. application Ser. No. 09/705,788, filed Nov. 6, 2000, issued as U.S. Pat. No. 6,698,150, which is a continuation of International Application No. PCT/CA00/00697, filed Jun. 9, 2000, and a continuation-in-part of U.S. application Ser. No. 09/328,901, filed Jun. 9, 1999, issued as U.S. Pat. No. 6,260,320. All of the patents and applications listed above are incorporated herein, in their entirety, by this reference to them.

FIELD OF THE INVENTION

This invention relates to construction systems using concrete panels.

BACKGROUND OF THE INVENTION

Concrete panel systems have been used primarily to provide pre-manufactured walls for residential or small commercial or industrial buildings. Such systems promise a more accurate building, reduced on-site building time and waste, insect resistance and a hedge against rising lumber prices.

U.S. Pat. No. 3,475,529 describes a method of making a prestressed hollow core concrete panel. A first section is formed comprising a slab having a flat outer face and a plurality of ribs extending from an inner face. This first section is then laid ribs down on a second section, which is either a flat slab or a duplicate of the first section laid ribs up. The two sections are joined together. In an embodiment, the cores of the panel are closed.

U.S. Pat. No. 3,683,578 describes a concrete panel building system in which the panels have an inner insulating layer sandwiched between concrete layers. The space between the concrete layers cooperates with a guide nailed to a foundation to align the wall panels on the foundation. Upper portions of adjacent wall panels are secured together by a various bolted connections.

U.S. Pat. Nos. 4,605,529, 4,751,803 and 4,934,121 describe concrete wall panels having vertical ribs extending between horizontal upper and lower beams all attached to a concrete slab which provides the outer surface of the wall. The ribs and beams of the panels are reinforced by longitudinal reinforcing bars and the concrete slab is reinforced by a wire mesh. A "bolting saddle" cast into the ends of the upper beams allows adjacent panels to be bolted together. U.S. Pat. No. 5,656,194 describes an improved assembly jig having hinged sidewalls for use in making such panels.

U.S. Pat. No. 5,493,838 describes a method of constructing a basement from prefabricated concrete panels. The building site is first excavated and footings are positioned in the excavation to define the outline of the building. The footings have a groove in their upper surface to accept wall sections which comprise a slab having a flat outer face and a plurality of ribs on an inner face. Freestanding corner wall sections are placed first on the footings. Flat wall panels are then joined end-to-end between the corner sections to complete a peripheral wall. A conventional wooden floor deck is constructed over the peripheral wall to strengthen the structure before the basement is backfilled.

SUMMARY

It is an object of the present invention to improve on the prior art. This object is met by the combination of features, steps or both found in the independent claims, the dependent claims disclosing further advantageous embodiments of the invention. The following summary may not describe all necessary features of the invention which may reside in a sub combination of the following features or in a combination with features described in other parts of this document.

In various aspects, the invention provides a concrete building panel having a slab and a plurality of ribs and beams. The ribs include interior ribs and end ribs which are generally perpendicular to the slab and oriented vertically in an installed panel. The beams include an upper and lower beam which are generally perpendicular to the slab and oriented horizontally in an installed panel.

The spacing of the ribs is determined in view if a fraction of the length or width of common sheet materials, the fraction having a numerator of 1 and a whole number denominator. A series of horizontal holes in the ribs are spaced at a selected constant spacing such that adjacent panels may be fastened together through them. Adjacent wall panels may be mounted with their bottom surfaces at different elevations, the elevations differing by the selected constant spacing.

A rabbet in the upper surface of the panel opens to the outside face of the panel to receive the exterior sheathing or finish material of a second wall panel mounted above the first wall panel. The second wall panel has an extension extending from its bottom surface into the rabbet of the lower wall panel. A smaller rabbet around some or all of the perimeter of the panel opens towards an outside face of the panel to receive water infiltration resisting material.

In one type of panel, the slab is separated from the ribs to provide an air gap. Reinforcing bar segments forming a series of at least partial triangles extend from the ribs to the slab to secure the slab in position relative to the ribs. Insulating blocks capable of resisting a compressive load are also provided between the slab and the ribs. The insulating blocks extend beyond the edges of the ribs to provide a surface for attaching sheet material between the ribs to close off the air gap.

Connections between holes in two adjacent concrete wall panels are made by a hollow conduit having an abutment at either end to engage the concrete wall panels. The abutments do not substantially block openings at the ends of the hollow conduit permitting materials to pass through the conduit. Preferably, the abutment on at least one end of the conduit is a nut threaded onto the conduit.

Other connections between adjacent panels involve horizontal channels in the exterior faces of the beams which extend from an edge of the panel to a hole through the beam. The horizontal channels of adjacent panels form a continuous channel. A stitch has a member which fits into the horizontal channels of two adjacent panels and legs which extend through the holes of the beams. The legs are adapted to receive a fastener to secure the stitch.

Other connections between adjacent panels involve vertical channels in the end ribs. The vertical channels of horizontally adjacent panels form a space. A plate is fitted into the space to provide an interference fit with the vertical channels to align the adjacent panels relative to each other. In some cases, the plate extends upwards into the space of a second pair of horizontally adjacent panels mounted on top of the first pair of horizontally adjacent panels.

Load bearing horizontal holes through the ribs are reinforced with reinforcing bar in the concrete arranged in generally triangular shapes. The load bearing holes and reinforcement are located such that apexes of the triangularly shaped reinforcement are located between the perimeter of the hole and the distal edge of the rib relative to the slab.

The concrete panels are made by providing a form having a base and sides which define the perimeter of the panel and sub-forms which define the space between the ribs. At least two sets of holes are made through the two opposed sides of the form and through two opposed sides of each sub-form. Each set of holes is concentric when the sub-forms are properly positioned in the form. The sub-forms are positioned in the form at least in part by placing rods through each set of concentric holes. Concrete is poured into the form to form the slab and the ribs. The rods are sized to produce holes in the ribs to accept the conduit connectors referred to above. The reinforcing bar is pre-assembled into a basket comprising wire mesh for the slab and trusses for the ribs.

BRIEF DESCRIPTION OF THE DRAWINGS

By way of example, embodiments of the invention will be described with reference to the following figures.

DETAILED DESCRIPTION OF EMBODIMENTS

General Structure of Concrete Panels

Figure 1:
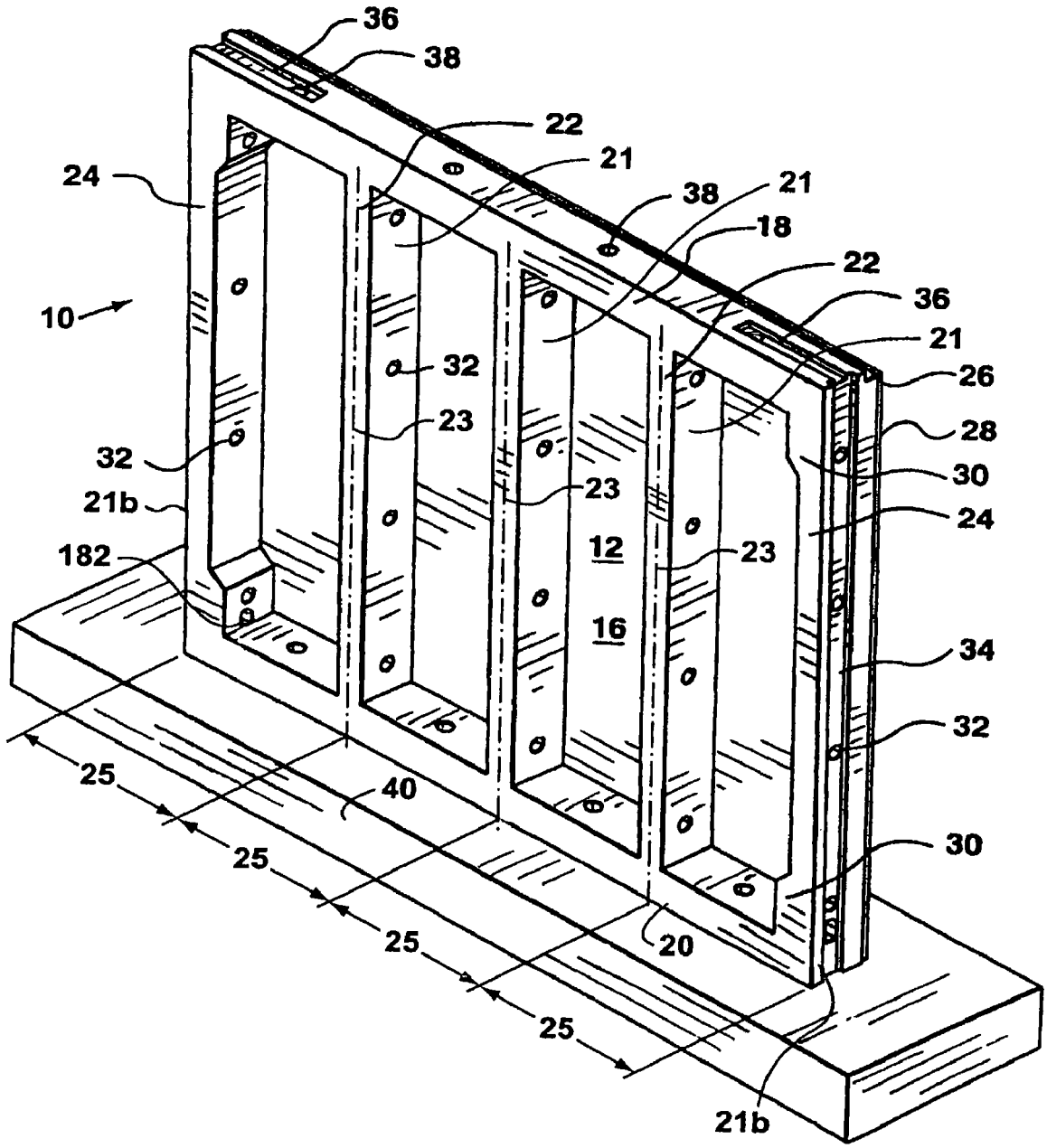
FIG. 1 is a perspective view of a first panel.
Figure 1A:
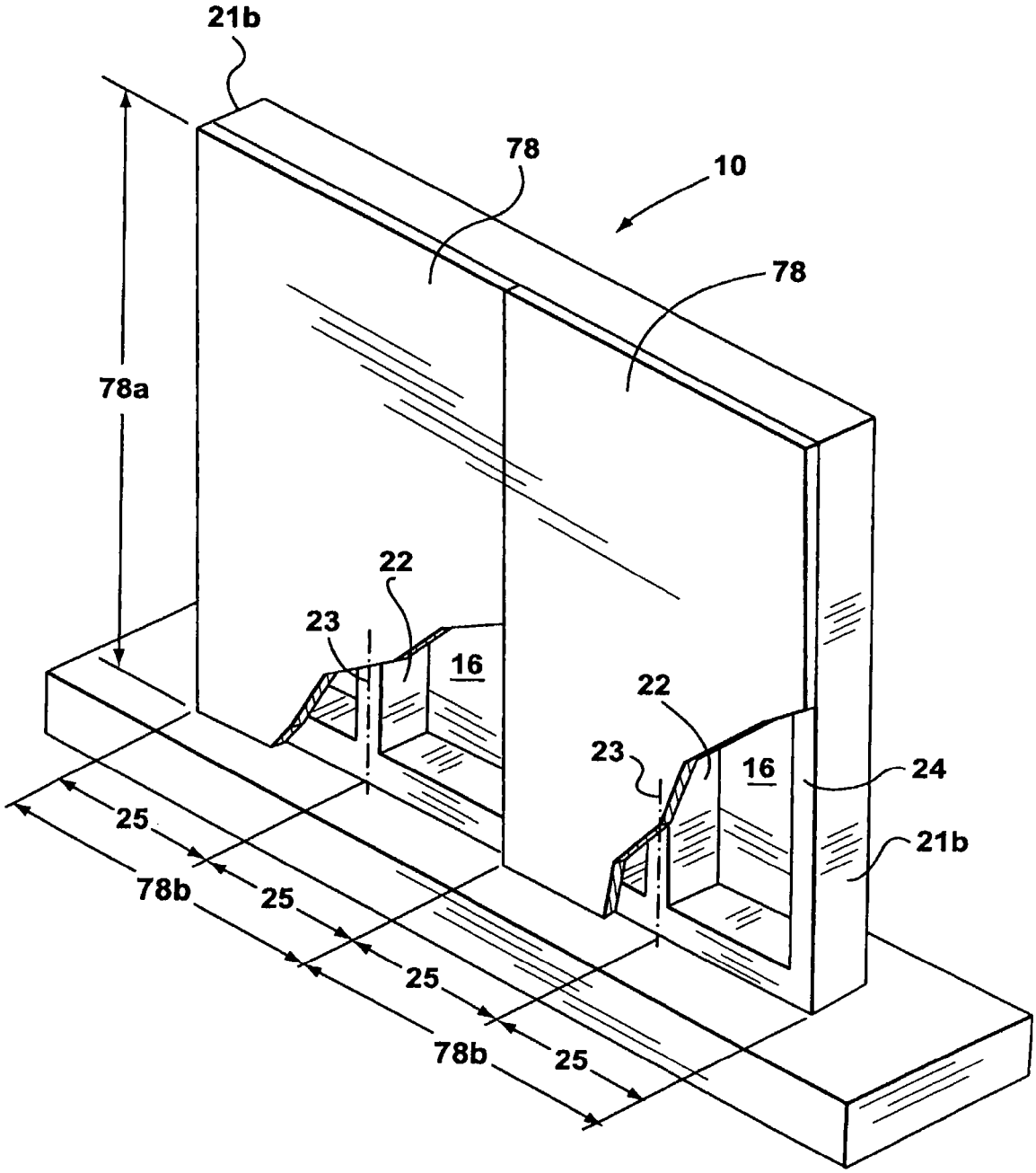
FIG. 1*a* is a perspective view of the panel of FIG. 1 with a sheet material attached to it.
Figure 2:
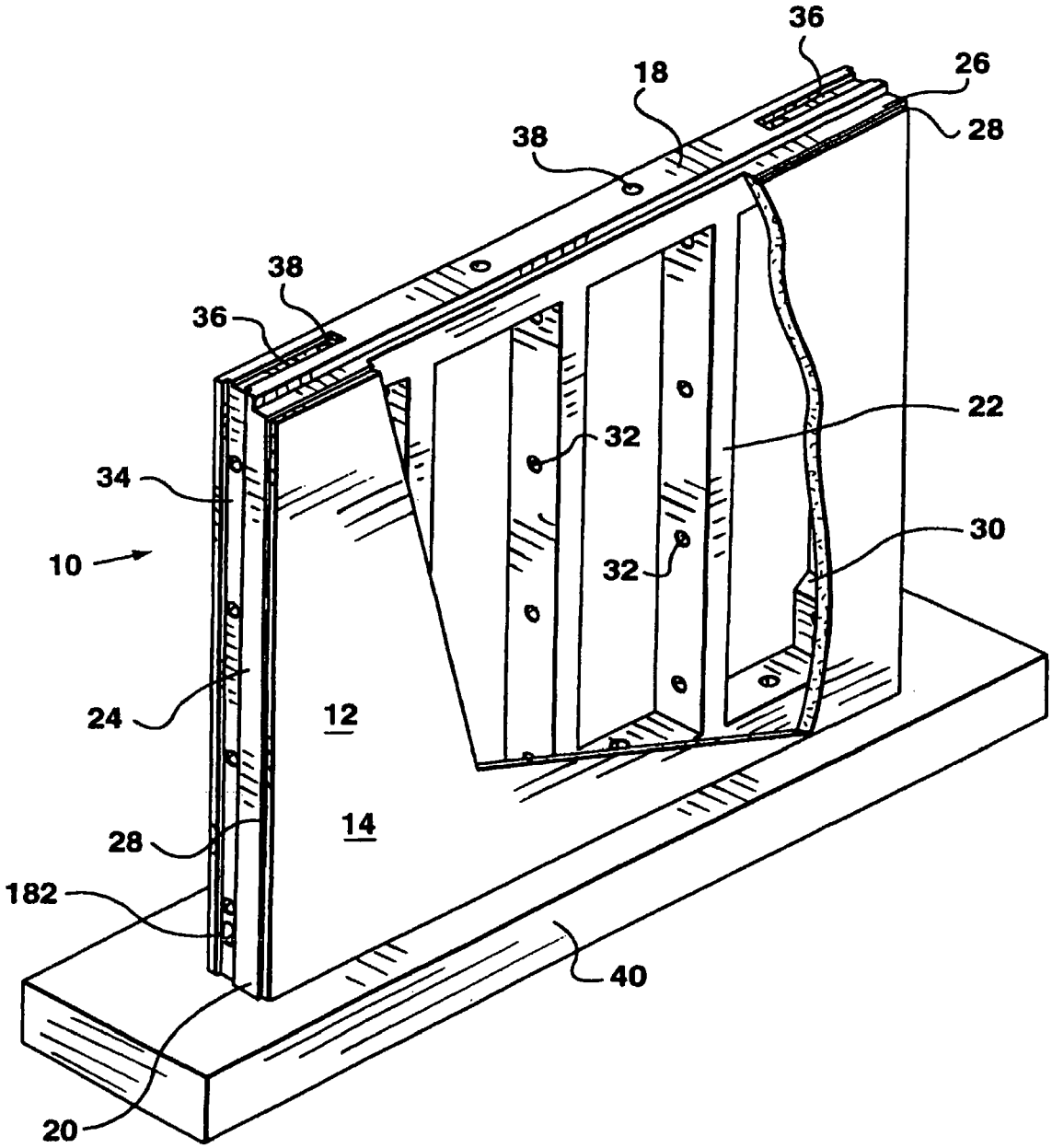
FIG. 2 is a perspective cutaway view of the first panel.
Figure 3:
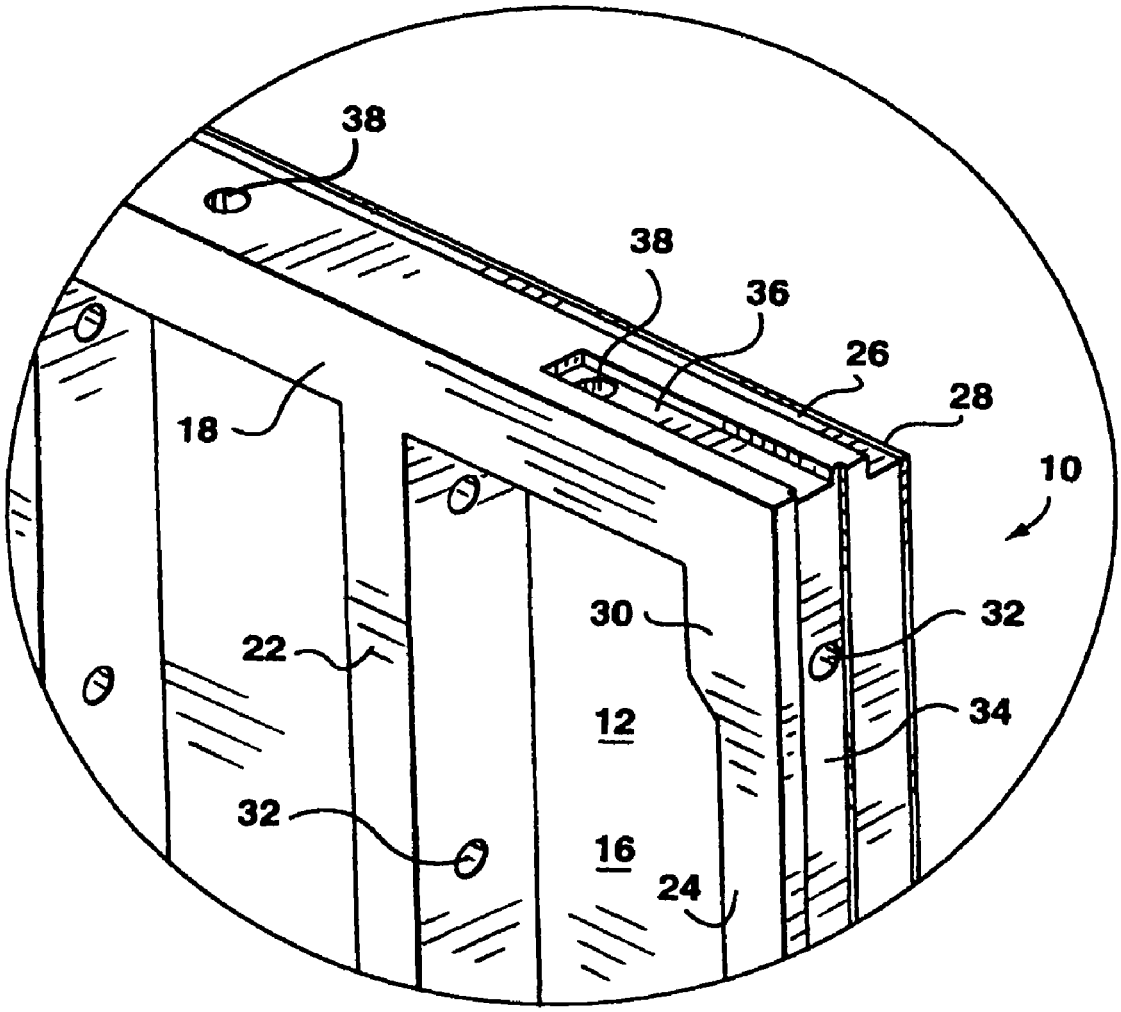
FIGS. 3 and 4 are perspective views of a corner of a first panel.
Figure 4:
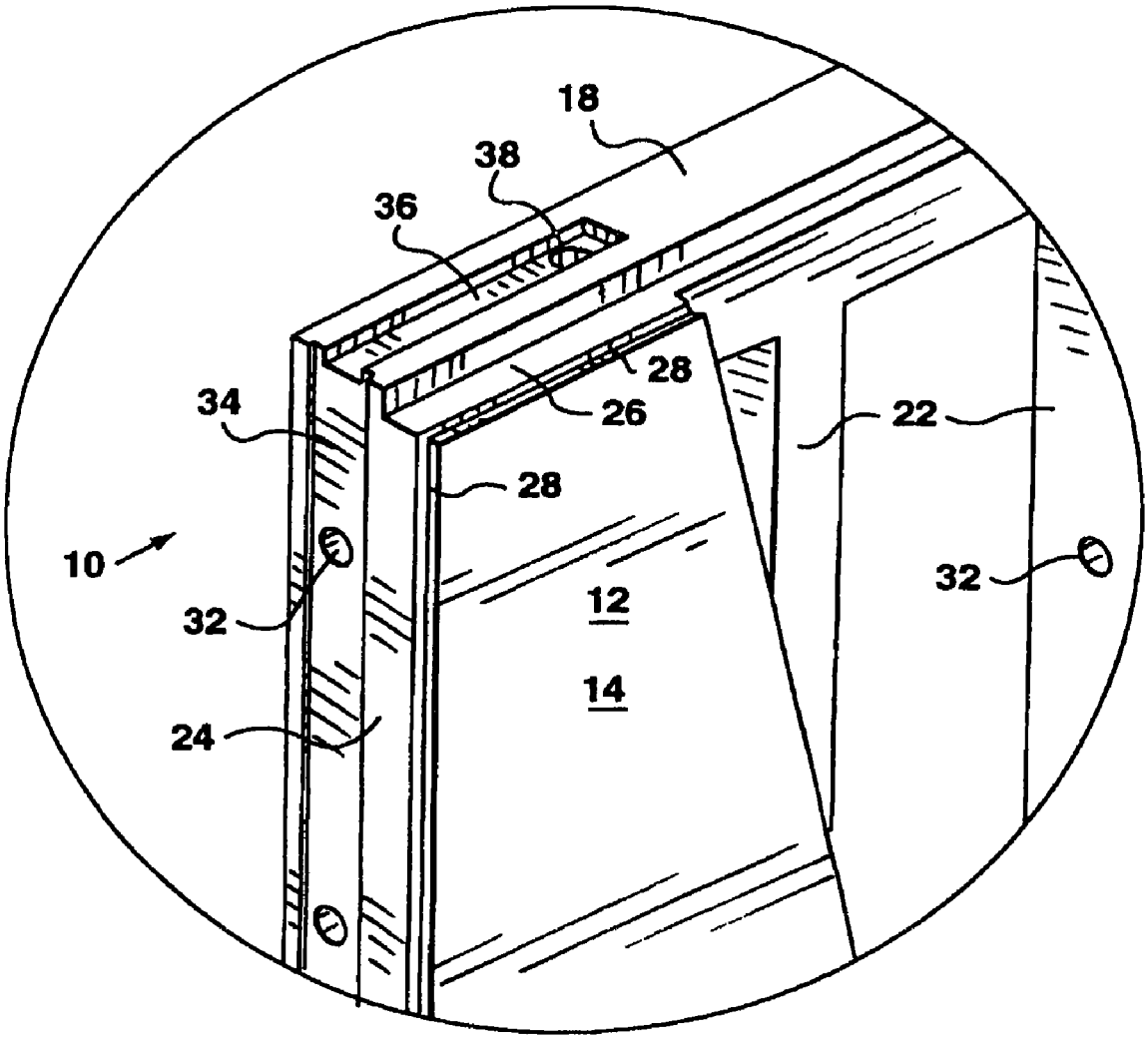

FIGS. 1 through 4 show a first panel 10 which is particularly useful for constructing basement walls. The first panel 10 comprises a slab 12 having an outside face 14 and an inside face 16. The slab 22 is typically one and a half to three inches thick. The outside face 14 of the panel 10 is typically also installed so that is also the outside face of a wall. The outside face 14 may be finished with a variety of architectural finishes or treatments such that the first panel 10 is both aesthetic and structural. Alternatively, however, the outside face 14 may be made to be the inside of a wall if appropriate modifications are made to the description below.

The slab 12 is integrally connected to a top beam 18 and bottom beam 20 which extend from the inside face 16 of the slab 12. Beams 18, 20 are generally perpendicular to the slab 12 and are generally horizontal in an installed first panel 10. Beams 18, 20 are typically about 2.5 inches thick, the thickness varying with their expected loading. The slab 12 and beams 18, 20 are integrally connected to interior ribs 22 and end ribs 24 which also extend from the inside face 16 of the slab 12. Ribs 22, 24 have side surfaces 21 extending from and generally perpendicular to the slab 12 and are generally vertical in an installed first panel 10. Interior ribs 22 have centerlines 23 extending along their length midway between side surfaces 21 and are typically spaced apart at a spacing interval 25 to conveniently accommodate the attachment of whole sheets of common sheet materials 78, such as drywall or plywood, having standard length and width dimensions 78*a* and 78*b* respectively. End ribs 24 have distal side surfaces 21 and are typically spaced so that centerlines 23 of interior ribs 22 and distal side surfaces 21 of adjacent end ribs 24 are spaced apart at spacing interval 25. Spacing interval 25 is a fraction of one of the standard length and width dimensions 78*a* and 78*b* of common sheet materials 78, wherein the fraction has a numerator of 1 and a denominator equal to a whole number. For example, in countries where sheet materials 78 often have standard width dimensions 78*b* of four feet and standard length dimensions 78*a* of eight feet, the spacing interval 25 between the centerlines 23 of adjacent interior ribs 22 or between the centerline 23 of an interior rib 22 and the distal side surface 21 of an adjacent end rib 24 is typically ½, ⅓, or ¼ of 4 feet, which corresponds to 24, 16, or 12 inches, respectively. Alternatively, the spacing interval 25 could be based on the 8 foot dimension of the common sheet materials, providing a spacing interval 25 of, for example, ¼, ⅕, or ⅙ of 8 feet, which corresponds to 24, 19.2 or 16 inches. The ribs 22, 24 typically range from 1.5 to 2.5 inches in thickness depending on their expected loading.

The length of the first panel 10 is variable but limited by the equipment available to physically handle the first panel 10. For house construction, a standard first panel 10 is typically eight feet wide. For commercial or industrial construction where heavier cranes are likely available, standard first panels 10 may be 12 or 16 feet long. The height of a first panel 10 may also vary from a typical height of eight feet to ten feet or more for buildings with high ceilings. The width of a first panel 10 is typically ten inches for residential basements but may vary for particular applications. To simplify the following discussion, the first panel 10 will be assumed to be 8 feet long by 8 feet high by 10 inches thick and to have three interior ribs 22 and two end ribs 24 spaced to provide support for sheet materials every 24 inches. For first panels 10 of other basic dimensions or configurations, parts of the description below may be modified as required.

The upper surface of the top beam 18 preferably has a major rabbet 26 opening to the outside face 14 of the first panel 10. The major rabbet 26 is typically about 3.5 inches wide and 1.5 deep. The major rabbet 26 receives the exterior sheathing or finish material of an adjacent upper wall structure. This makes it difficult for water running down that sheathing or finish material to enter the building by flowing across the upper surface of the top beam 18. The first panel 10 is also surrounded by a minor rabbet 28 (best shown in FIGS.

3 and 4) opening to the outside face 14 of the first panel 10. This minor rabbet 28 is typically about ⅛ inch deep and provides a recess to receive a cord and caulking. The cord and caulking help keep water out of the joint between a first panel 10 and adjacent first panels 10 or other building elements. With the minor rabbet 28, adjacent panels 10 can be butted directly against each other instead of placing adjacent panels with a slight gap between them for cord and caulking as in typical prefabricated panel construction.

The tops and bottoms of the end ribs 24 preferably include a widened portion 30 extending into the beams 18, 20. This widened portion 30 provides space for increased interior metal reinforcement as well as more concrete to strengthen the corners of the first panel 10.

The ribs 22, 24 are each provided with an equal number of horizontal holes 32 located at substantially the same elevations. These horizontal holes 32 have an appreciable diameter, typically about two and one eighth inches. As will be discussed further below, the horizontal holes 32 are used to attach a first panel 10 to an adjacent wall panel and at least one horizontal hole 32 preferably extends through each widened portion 30. The horizontal holes 32 also provide space to run electrical wiring or plumbing etc. through first panels 10. The vertical spacing of the horizontal holes 32 is preferably determined as follows. A nominal spacing is selected which gives an acceptable number of horizontal holes 32. A first hole, which can be the highest or lowest horizontal hole 32, is located so that its centre is at least a few inches from the closest beam 18, 20 and the centre of a last whole will also be at least a few inches from the closest beam 18, 20. Other horizontal holes 32 are placed with their centres at a multiple of the nominal spacing from the first hole. For example, an first panel eight feet high typically has horizontal holes 32 located at one foot, three feet, five feet and seven feet from the top or bottom of the first panel 10.

The end ribs 24 have vertical channels 34 in their outer sides preferably extending along their entire length. The vertical channels 34 cross the faces of the horizontal holes 32. The vertical channels 34 are typically about ¼ inch deep and four inches wide. The vertical channels 34 continue into horizontal channels 36 in the upper surfaces of the top beam 18 and, optionally, the lower surfaces of the bottom beam 20. The horizontal channels 36 are typically narrower than the vertical channels 34. The horizontal channels 36 extend from the vertical channels 34 to a proximal vertical hole 38.

Other vertical holes 38 are also provided in the beams 18, 20. These vertical holes 38 may be of the same size as the horizontal holes 32 and serve a similar purpose. An exception, however, is vertical holes 38 in a beam 18, 20 that do not intersect a horizontal channel 36 and are not used to provide a conduit for services. Such vertical holes 38 may be of a smaller diameter and may be located on different spacings. Vertical holes 38 may be used to attach a first panel 10 to a foundation or other building element.

Figure 5:
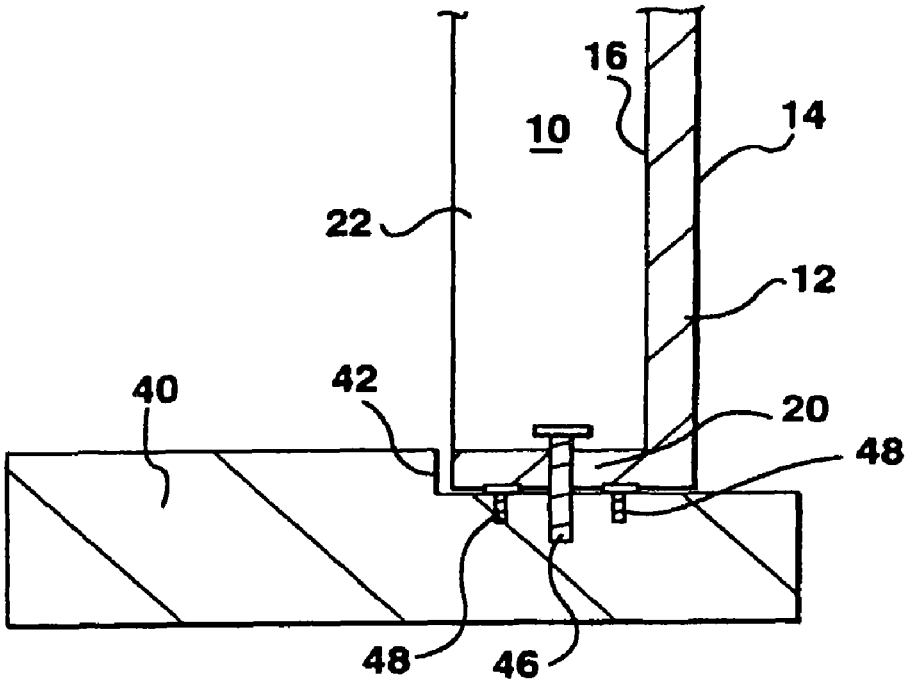
FIGS. 5 and 6 are cross sections of connections between panels and footings.
Figure 6:
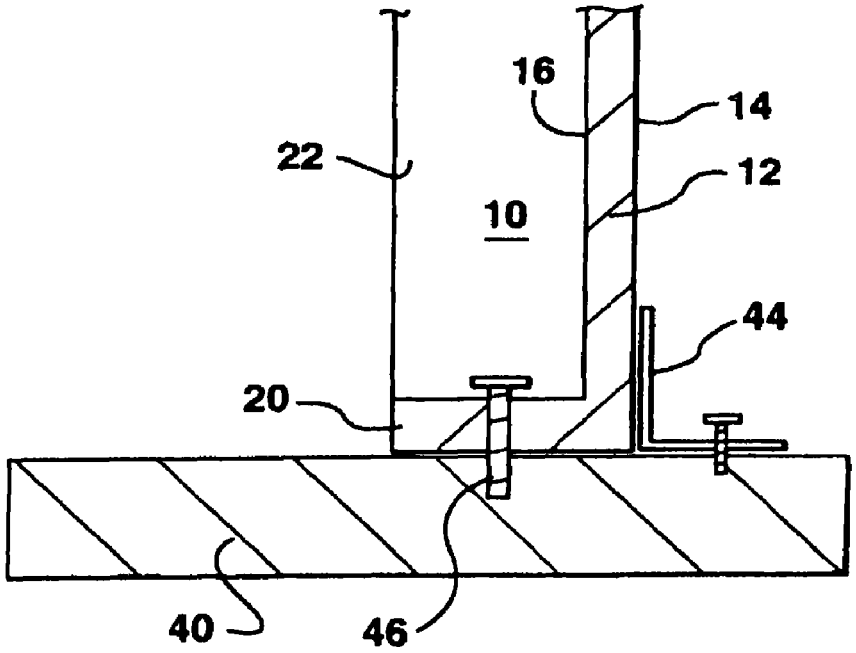

The first panel 10 typically rests on a footing 40. FIGS. 5 and 6 show typical connections between a first panel 10 and a footing 40. In FIG. 5, a step 42 is provided in the footing 40 to help locate the first panel 10 relative to the footing 40. In FIG. 5, a section of angle iron 44 is bolted to the foundation 40 for the same purpose. In both cases, foundation bolts 46 run through vertical holes 38 of the bottom beam 20 and are threaded, grouted or epoxied into the foundation 40. Optionally, the footing 40 may be provided pairs of levelling buttons 48, typically two pairs per panel, which project from the footing 40. The upper surface of the levelling buttons 48 is set at a selected elevation by screwing the levelling buttons 48 into or out of nuts cast into or attached onto the foundation 40. The upper surface of the levelling buttons 48 helps ensure that each first panel 10 is installed horizontally and that adjacent first panels 10 are at the same elevation despite an uneven foundation 40. The levelling buttons 48 also prevent an excess of mortar between the foundation 40 and the first panel 10 from being squeezed out of that joint.

Figure 7:
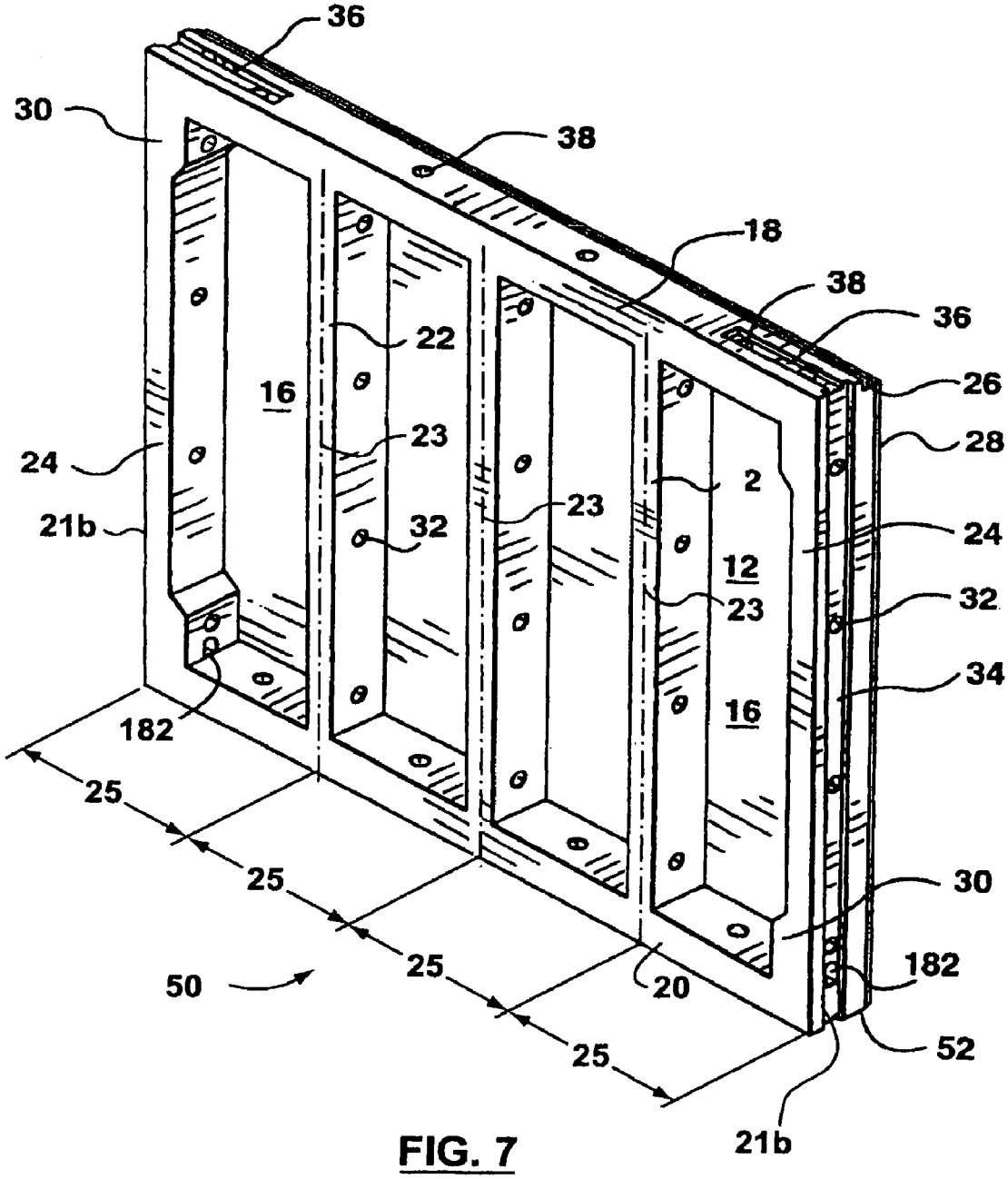
FIG. 7 is a perspective view of a second panel.

FIG. 7 shows a second panel 50 which is particularly useful for constructing above grade walls. The second panel 50 is similar to the first panel 10. The description and reference numerals used for the first panel 10 apply to the second panel 50 except as will be described below. Further, parts of the description of the first panel 10 which implicitly do not relate to an above grade panel, such as the attachment of the first panel 10 to a foundation, do not apply to the second panel 50.

Figure 18:
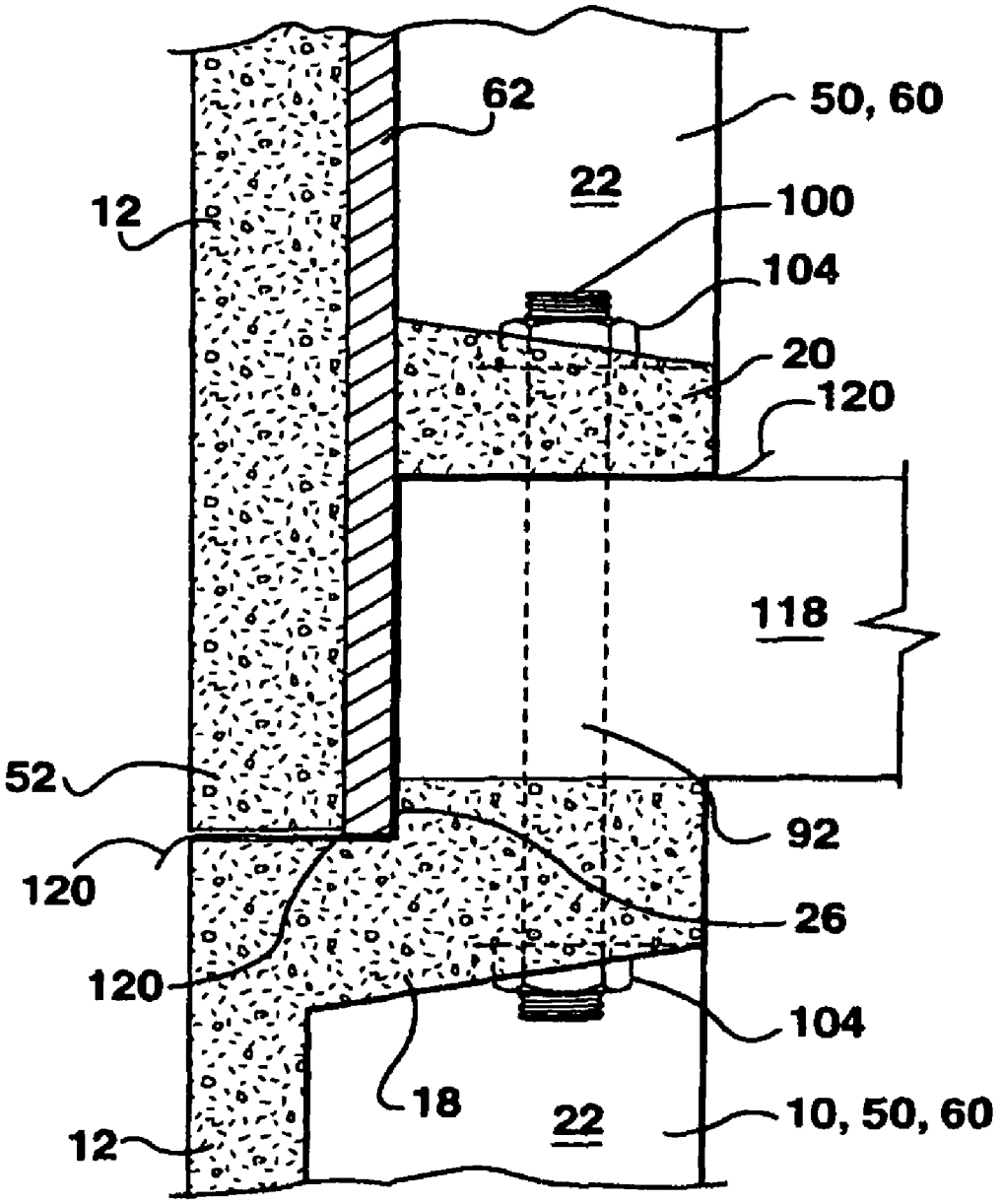
FIG. 18 is a cross section of a bolted vertical connection between panels and a floor deck.

In general, the second panel 50 may be sized and reinforced unlike the first panel 10 as required by the loading on an above grade wall as compared to a basement wall. The bottom beam 20 may be made wider than required for strength, however, to distribute the weight of the second panel 50 particularly when a second panel 50 will be installed on a wood floor deck. The second panel 50 also has an extension 52 which protrudes from the lower surface of the bottom beam 20 extending the outside face 14 of the second panel 50 downwards. This extension 52 is sized to fit into the major rabbet 26 of a lower first panel 10 or second panel 50. Where a floor deck is mounted on the lower first panel 10 or second panel 50, the extension 52 is longer than shown in FIG. 7 as required as shown in FIG. 18.

Figure 8:
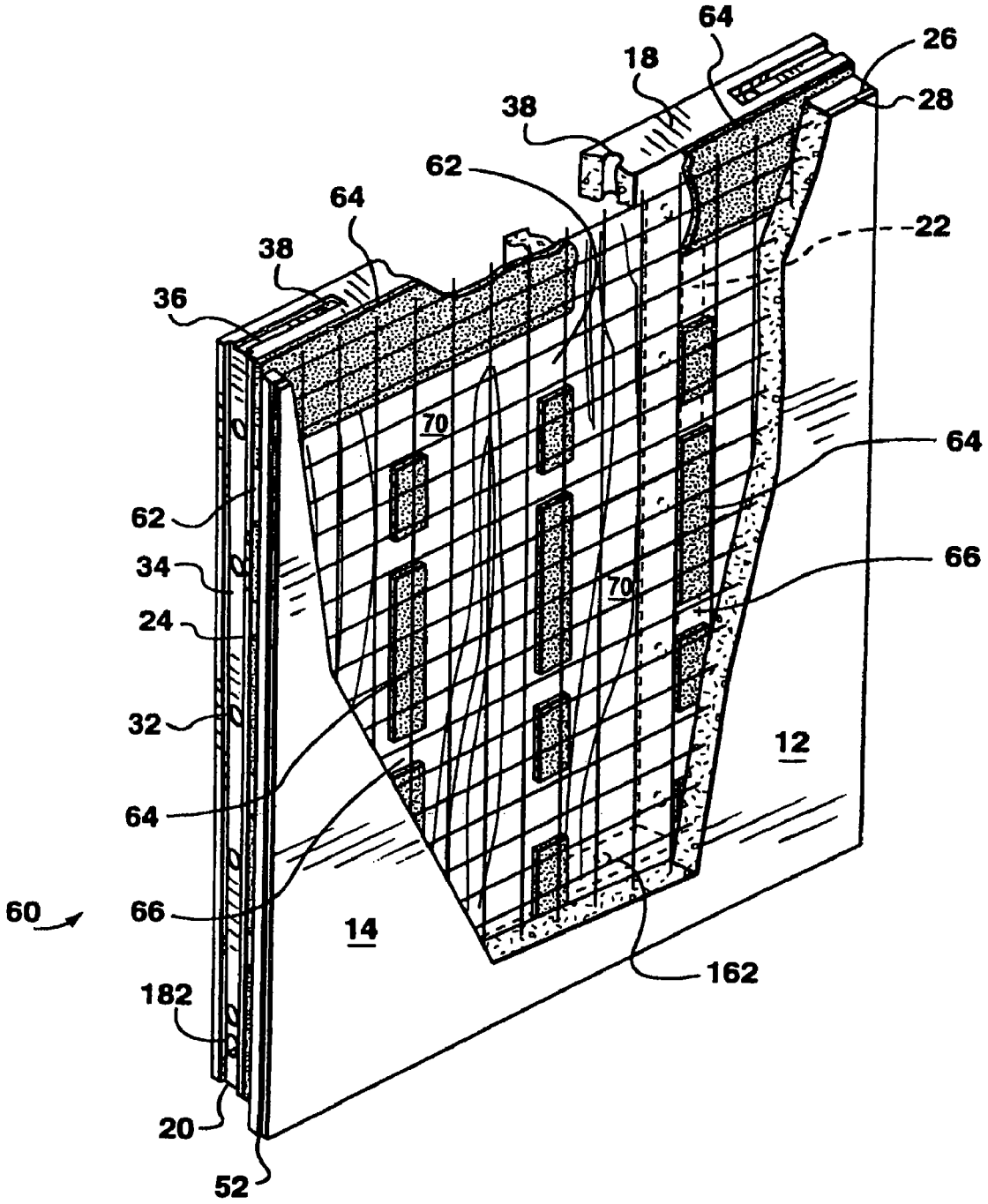
FIGS. 8 and 9 are perspective and partial cross sectional views respectively of a third panel.
Figure 9:
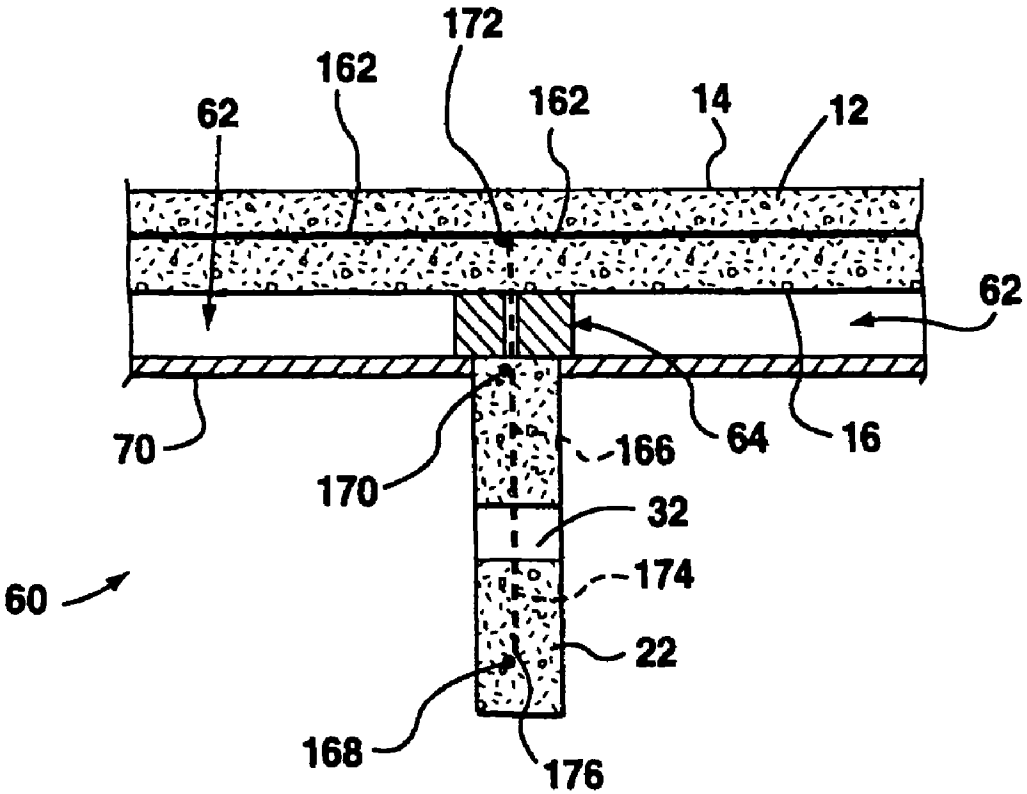

FIGS. 8 and 9 show a third panel 60 which is also particularly useful for constructing above grade walls. The third panel 60 is similar to the first panel 10 and second panel 50 and the description and reference numerals above applies generally to the third panel 60 except as will be described below. As for the second panel 50, parts of the description of the first panel 10 which do not relate to an above grade panel do not apply to the third panel 60.

The third panel 60 has an air gap 62 between the slab 12 and the beams 18, 20 and ribs 22, 24. The air gap 62 acts as a thermal break, a capillary break and as a channel to allow water or water vapour to flow out of the wall. The beams 18, 20 and ribs 22, 24 are spaced from the slab 12 by insulating blocks 64 which are arranged or drilled to provide passages across ribs 22, 24 (including ribs of adjacent third panels 60) and, in some applications, across beams 18, 20 (not illustrated). A preferred material for the insulating blocks 64 is a composite of polyethylene and cellulose or wood flour which is non-rusting, insulating and strong in compression such as POLYBOARD™, sold by Renew Resources of Toronto, Ontario, Canada.

The beams 18, 20 and ribs 22, 24 are connected to the slab 12 by metal reinforcement which will be described further below. The insulating blocks 64 preferably surround any metal reinforcement crossing the air gap 62 to inhibit condensation and rusting. Optionally, reinforcement that crosses the air gap 62 can be treated to prevent rusting, for example, by coating it with epoxy. Inner sheets 70, typically plywood or oriented strand board, extend between adjacent insulating blocks 64. The inner sheets 70 keep insulation placed between ribs 22, 24 out of the air gap 62 and may also support vapour or water barriers as required. The structure of the third panel 60 thus resembles many of the feature of a conventional stud wall with masonry facing.

Like the second panel 50, the third panel 60 has an extension 52 which protrudes from the lower surface of the bottom beam 20 and extends the outside face 14 of the third panel 60 downwards. The extension 52 of the third panel 60 is similarly sized to fit into the major rabbet 26 of a lower first panel 10 or second panel 50 but the extension 52 is not as thick as a major rabbet 26 so that the air gap 62 will be in fluid communication with a major rabbet 26.

The description of the panels 10, 50, 60 above relates primarily to standard sized panels. Since most buildings are not sized as even multiples of the width of standard panels 10, 50, 60, custom panels are made as required by making suitable modifications to the description above. Similarly, modified panels are made for corners. The following description applies to corners made of any of the panels 10, 50, 60 discussed above.

Figure 10:
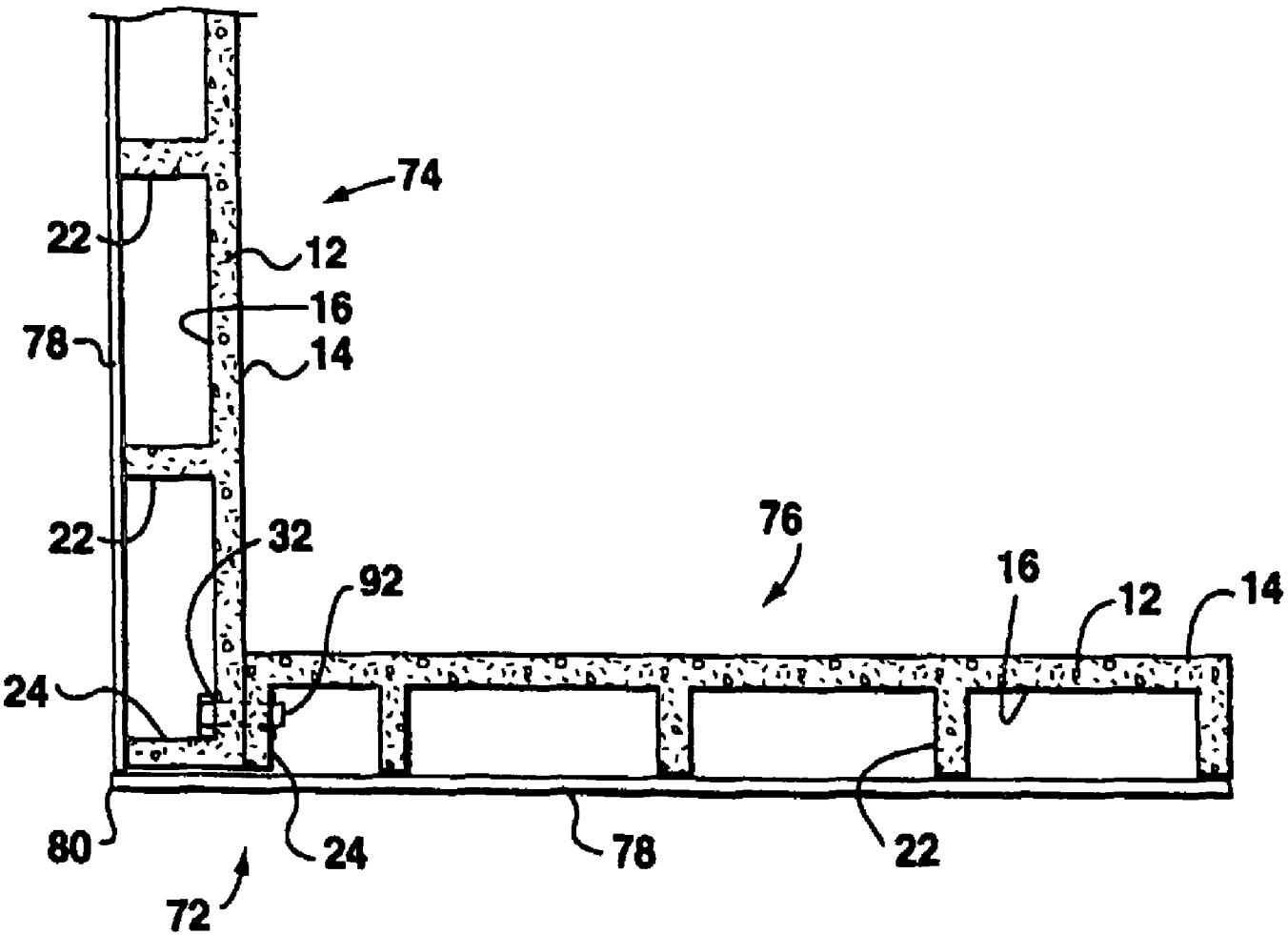
FIGS. 10 and 11 are cross sections of corner connections between panels.

FIG. 10 shows a first corner 72 between first and second corner panels 74, 76. The first corner panel 74 has additional horizontal holes 32 in its slab 12 which correspond with horizontal holes 32 in the end rib 24 of second corner panel 76. This permits pipe bolts 92 (to be discussed further below) to connect the corner panels 74, 76. To accommodate attaching whole sheet materials such as drywall 78 to the second corner panel 76, the spacing between its end rib 24 and the interior rib 22 closest to the end rib 24 is decreased. The decreased spacing is selected so that the distance between the centre of that closest interior rib 22 and the apex 80 of the first corner 72 is equal to an even fraction of the width of common sheet materials.

Figure 11:
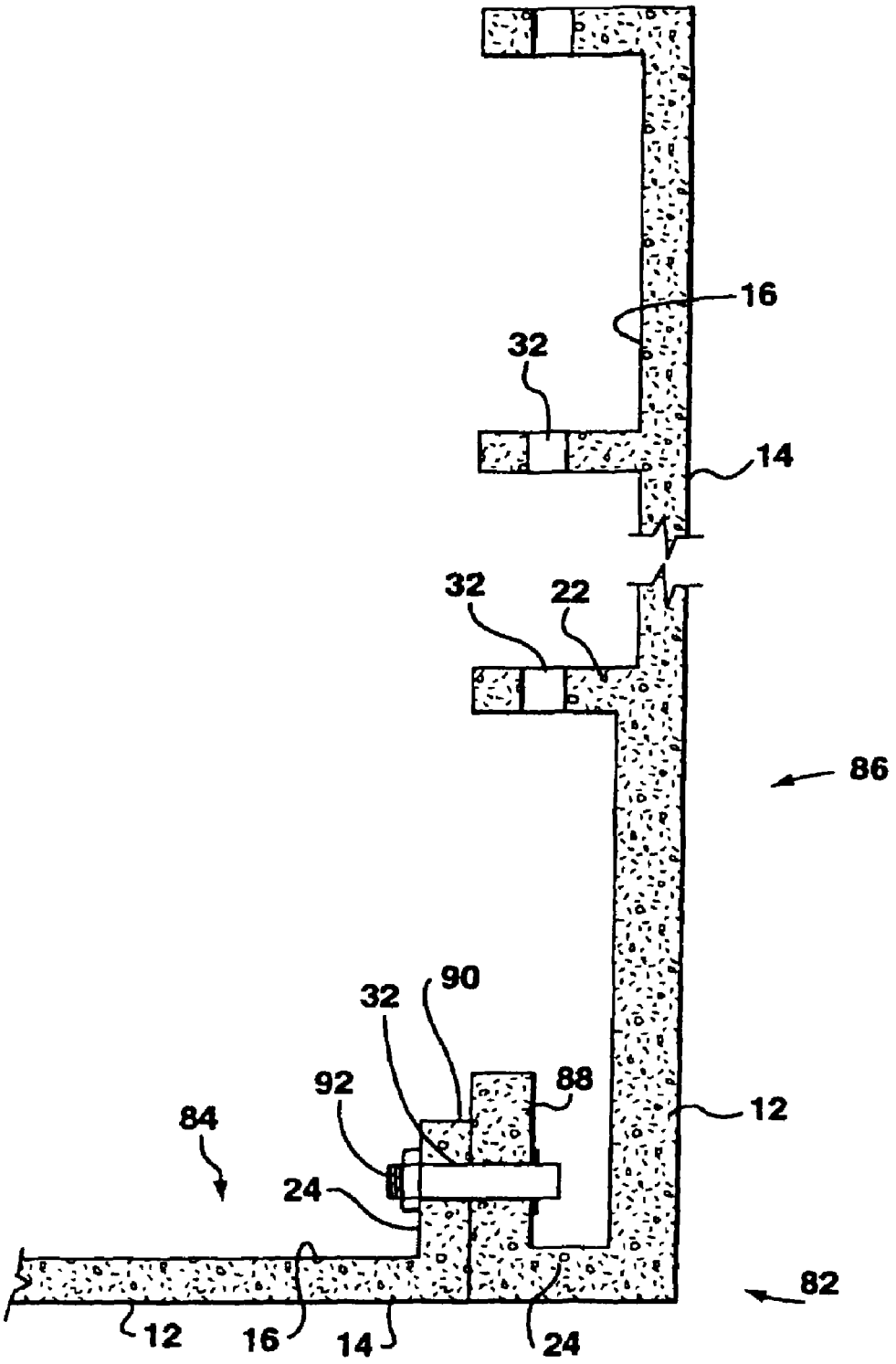

FIG. 11 shows a second corner 82 between third and fourth corner panels 84, 86. The third corner panel 84 is substantially unmodified from the description of panels 10, 50, 60 above. The fourth corner panel has a return 88 extending from an end rib 24. The return 88 has horizontal holes 32 which permits pipe bolts 92 to connect the corner panels 84, 86. To accommodate attaching un-cut sheet materials such as drywall 78 to the fourth corner panel 86, the spacing between its end rib 24 and the interior rib 22 closest to the end rib 24 is increased. The increased spacing is selected so that the distance between the centre of that closest interior rib 22 and the interior apex 90 of the second corner 82 is generally equal to an even fraction of the width of common sheet materials. The return 88 extends beyond the end rib 24 of the third corner panel 84 by an inch or two to support the edge of drywall 78 attached to the fourth corner panel 86.

Connections Between Concrete Panels and Other Building Elements

Figure 12:
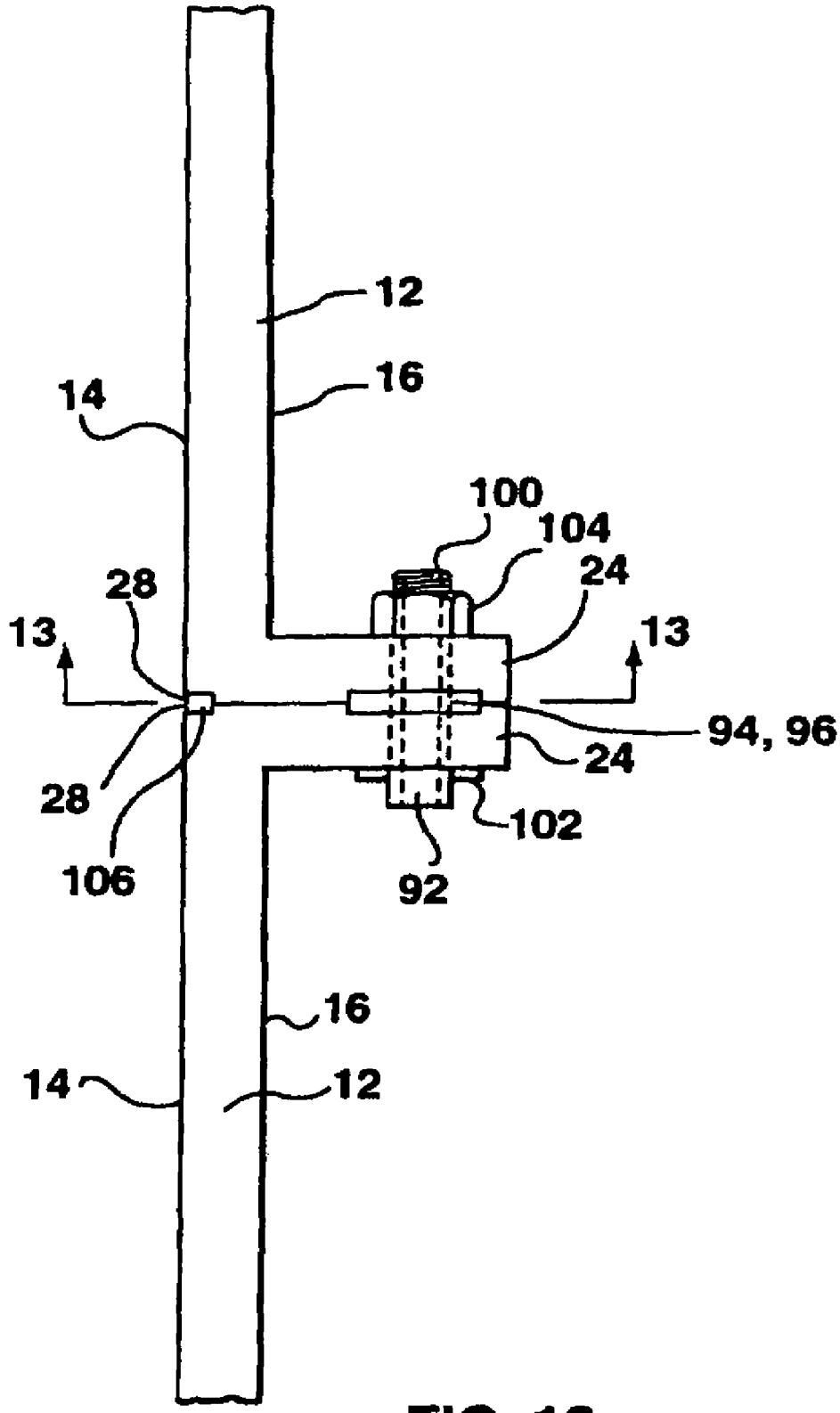
FIG. 12 is a plan view of a bolted connection between panels.
Figure 13:
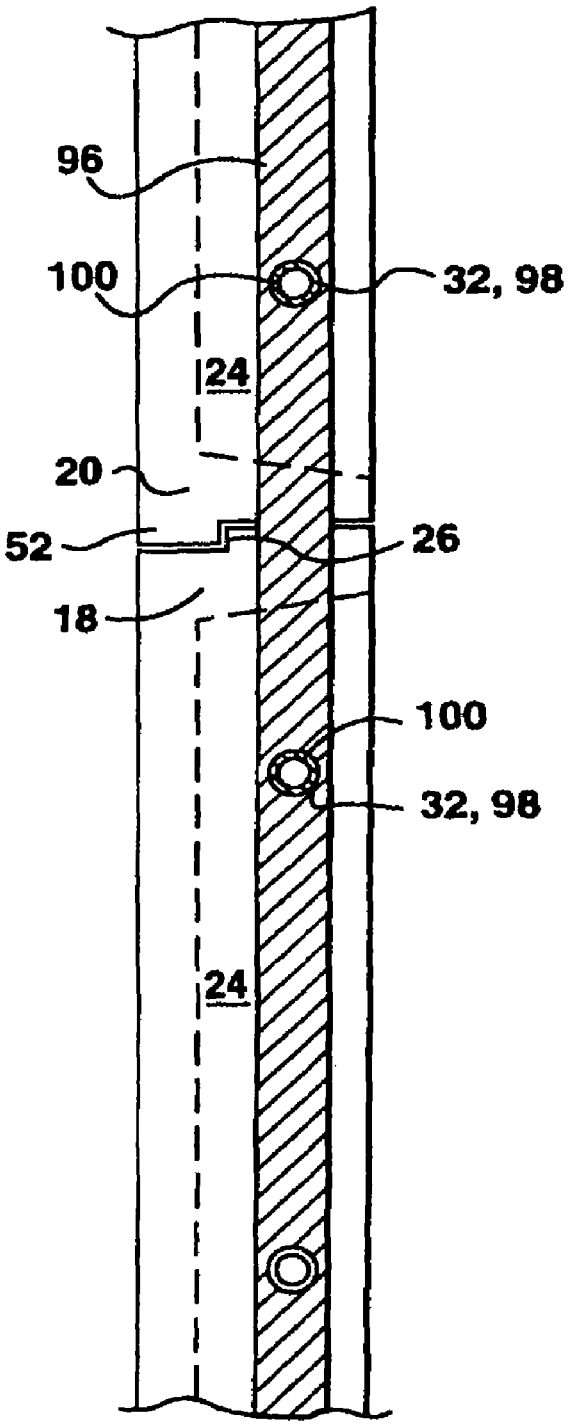
FIG. 13 is a cross section of a vertical plated connection between panels.

FIGS. 12 and 13 show connection between adjacent panels 10, 50, 60. When two panels 10, 50, 60 are placed side by side, their horizontal holes 32 align to create continuous passages between their end ribs 24. Their vertical channels 34 also create a slot 94 capable of receiving a plate 96, typically made of steel, having plate holes 98 spaced at the nominal spacing of the horizontal holes 32. The plate 96, typically about four inches by one half inch in section but slightly smaller than the slot 94, is inserted from above the panels 10, 50, 60 to generally fill slot 94 and hold the panels 10, 50, 60 in alignment with each other. In FIG. 13, the plate 96 also extends upwards to align and attach vertically adjacent panels 50, 60. Preferably such a plate 96 extends into each panel 10, 50, 60 by at least four feet. As shown in FIG. 12, caulking 106 seals the space left by the minor rabbets 28.

The connection is completed by inserting pipe bolts 92 through the horizontal holes 32 and plate holes 98 and tightening them. Typically, a pipe bolt 92 is fastened through each horizontal hole 32 of adjacent end ribs 24 and optionally through each vertical hole 38 of vertically adjacent beams 18, 20 (not illustrated). The pipe bolts 92 consist of a section of hollow pipe 100, typically steel, of about two inches in outside diameter. The horizontal holes 32 are preferably slightly larger in diameter (ie. by about one eight of an inch) than the pipe 100 to permit a small amount of adjustment between panels 10, 50, 60 or to compensate for slight misalignment of the panels 10, 50, 60.

The pipe 100 is drilled to receive a pin 102 at one end and threaded on its other end to receive a nut 104. Alternatively, the pipe 100 may be threaded on both ends and have two nuts 104. In either event, tightening at least one nut 104 draws adjacent panels 10, 50, 60 together. Because the pipes 100 are hollow, however, wire or conduits can still be passed through horizontal holes 32 or vertical holes 38. The pipe 100 also presents more surface area in contact with the end ribs 24 than would a typical bolt and thus reduces the possibility the a force applied between the pipe 100 and an end rib 24 or beam 18, 20 crushes the concrete around a hole 32, 38.

Figure 14:
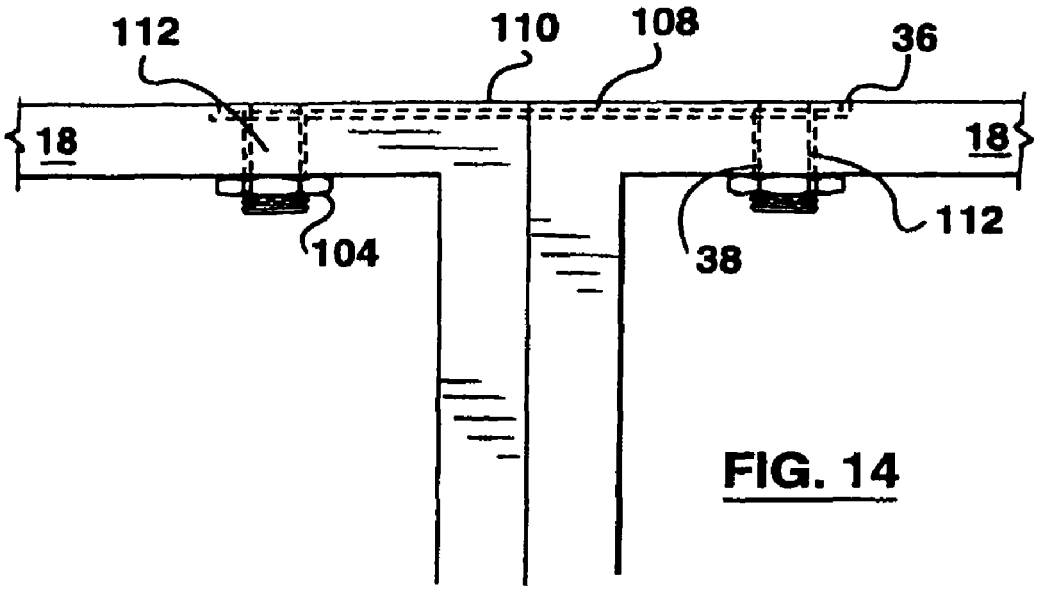
FIGS. 14, 15 and 16 are an elevational view of a stitched connection, an elevational view of a stitch and a plan view of a stitched connection respectively.
Figure 15:
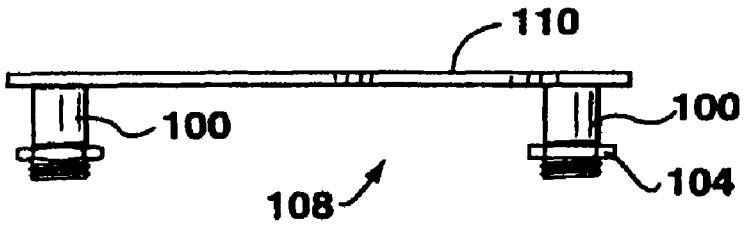
Figure 16:
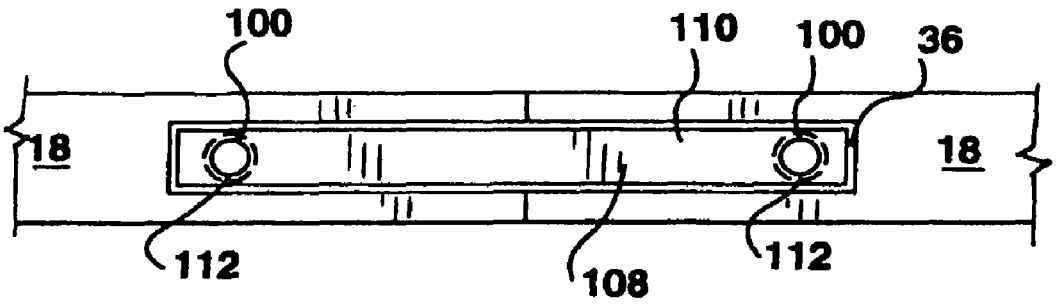

In addition to or in place of the plate 96, a stitch 108 can be used to attach horizontally adjacent panels 10, 50, 60. As shown in FIGS. 14, 15 and 16, the stitch 108 has an upper member 110, typically plate steel, and two extending legs 112, typically made of the same hollow threaded pipe of the pipe bolts 92. The legs 112 may be welded, bolted or threaded to the upper member 110. The upper member 110 may close the opening in the legs 112 or be holed so that wires or conduits can pass through the stitch 108.

The upper member 110 of the stitch 108 fits into the horizontal channels 36 of adjacent panels 10, 50, 60. The legs 112 extend through vertical holes 38 in the beams 18, 20. Stitch nuts 114 are then threaded onto the legs 112 and tightened. Depending on the application, stitches 108 may be used on the bottom beams 20, top beams 18 or both of adjacent panels 10, 50, 60.

When a stitch 108 is used without a plate 96, the stitch 108 performs the function of keeping panels 10, 50, 60 aligned while pipe bolts 92 are being fastened. This allows, as an alternative to the arrangement shown in FIG. 13, the vertical seems between plates 10, 50, 60 of one floor of a building to be staggered relative to the vertical seems between plates 10, 50, 60 of a vertically adjacent floor. When a stitch 108 is used with a plate 96, a slot is made in the plate 96 to accommodate the stitch 108. The slot is made of sufficient size and shape to allow one side of the stitch 108 (and its leg 112) to pass through the slot and to allow the stitch 108 to move upwards or downwards as required to slide the legs 112 into vertical holes 38. Alternatively or additionally, a connection between four panels 10, 50, 60 can be made by placing a stitch 108 with longer legs 112 on top of the bottom beam 20 of two horizontally adjacent panels 50, 60. The legs 112 pass through vertical holes 38 of the two horizontally adjacent panels 50, 60 and though the vertical holes 38 of another two horizontally adjacent panels 10, 50, 60 located directly below the first two horizontally adjacent panels 50, 60. A stitch access hole 182 (as shown in FIG. 7 for example) is provided in the sides of end ribs 24 just above the tops of bottom beams 20 to accommodate such a stitch 108 passing between two horizontally adjacent panels 10, 50, 60.

Figure 17:
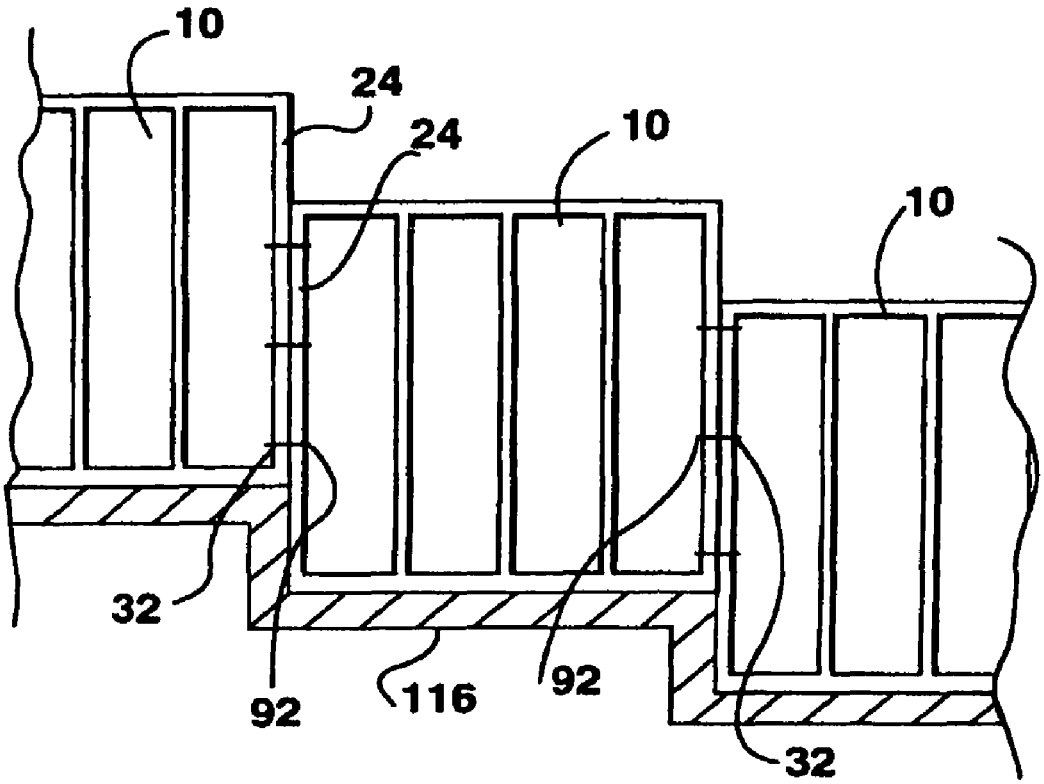
FIG. 17 is an elevation of first panels installed on a stepped foundation.

FIG. 17 shows a series of first panels 10 descending down a stepped footing 116. The steps in the stepped footing are made as high as the nominal spacing of the horizontal holes 32. In this way, pipe bolts 92 may be used to attach adjacent first panels 10 together. The upper surface of the first panels 10 can be leveled by placing short first or second panels 50, 60 on top of them or by using a series of first panels 10 of increasing height.

FIG. 18 shows an alternative connection between vertically adjacent panels 10, 50, 60 using pipe bolts 92 instead of plates 96. In addition, a conventional floor deck 118 is inserted between a lower panel 10, 50, 60 and an upper panel 50, 60. Plastic sheet 120 extends from outside the major rabbet 26 of the lower panel 10, 50, 60, upwards along the end of the floor deck 118 and along the top of the floor deck 118 to the interior of the wall. Where utilities do not need to pass between vertically adjacent panels 10, 50, 60, the pipe bolts 92 may be replaced with regular bolts.

The connections of FIGS. 13 and 18 may be combined. In either of the vertical connections of FIG. 13 or 18, the lower edge of the extension 52 of the upper panels 10, 50, 60 has drainage holes, preferably on about four foot centres. The drainage holes are typically about ¼ inch in diameter and permit water trapped in the joint between vertically adjacent panels 10, 50, 60 or running down through an air gap 62 to leave the wall. The plastic sheet 120 of FIG. 18 is typically also used in the connection of FIG. 13.

Figure 19:
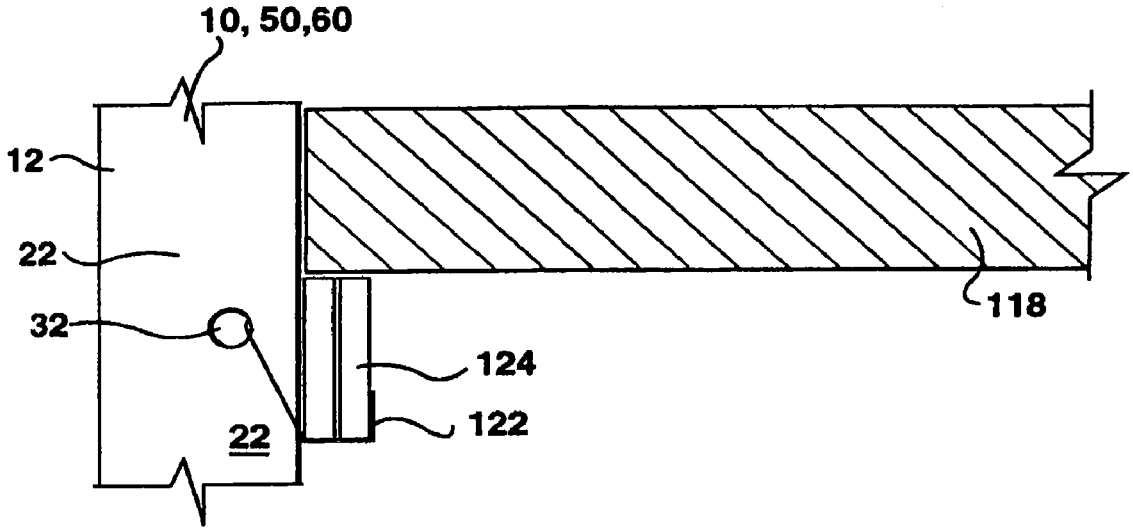
FIGS. 19 and 20 are connections between a floor deck and panels utilizing horizontal holes in the panels.
Figure 20:
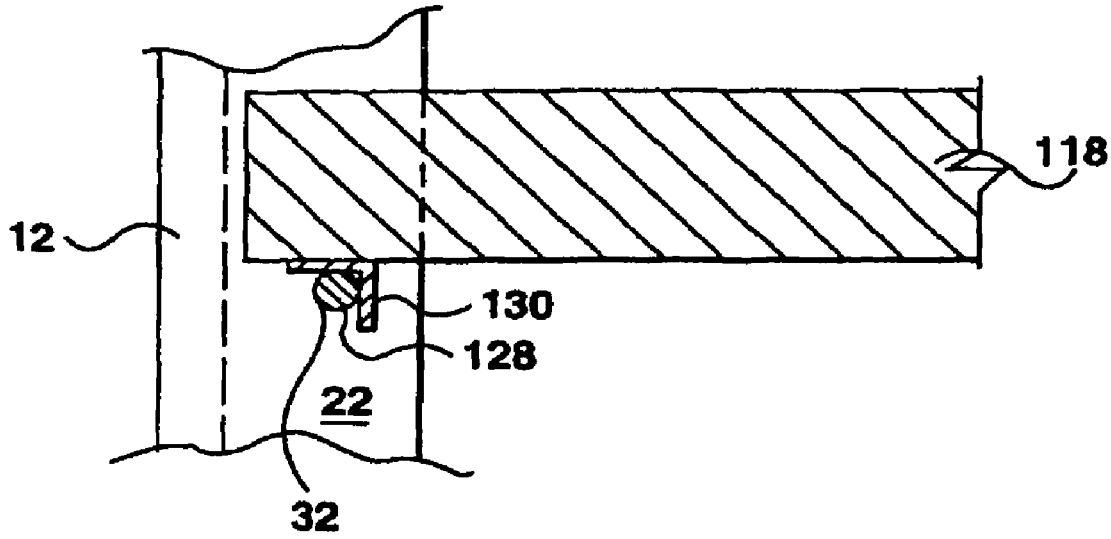

FIGS. 19 and 20 show two other methods by which a conventional floor deck 118 is supported by panels 10, 50, 60. In FIG. 19, hangers 122 are bent from strips of steel plate typically about one and one half inches wide. First ends of each hanger 122 are hooked into a series of horizontal holes 32 at a common elevation. Second ends of hangers 122 are bent to form supports for a beam 124. Joists 126 are toe-nailed to the tops of the beams 124 or supported by joist hangers nailed to the beams 124. In FIG. 20, an elongated pipe 128, similar in cross section and material to the pipe 100 of a pipe bolt 92, is placed through several horizontal holes 32 at a common elevation. An abutment 130, typically a length of angle iron, is attached to the elongated pipe 128. A floor deck 118 can then be attached to the upper surface of the abutment 130.

Figure 29:
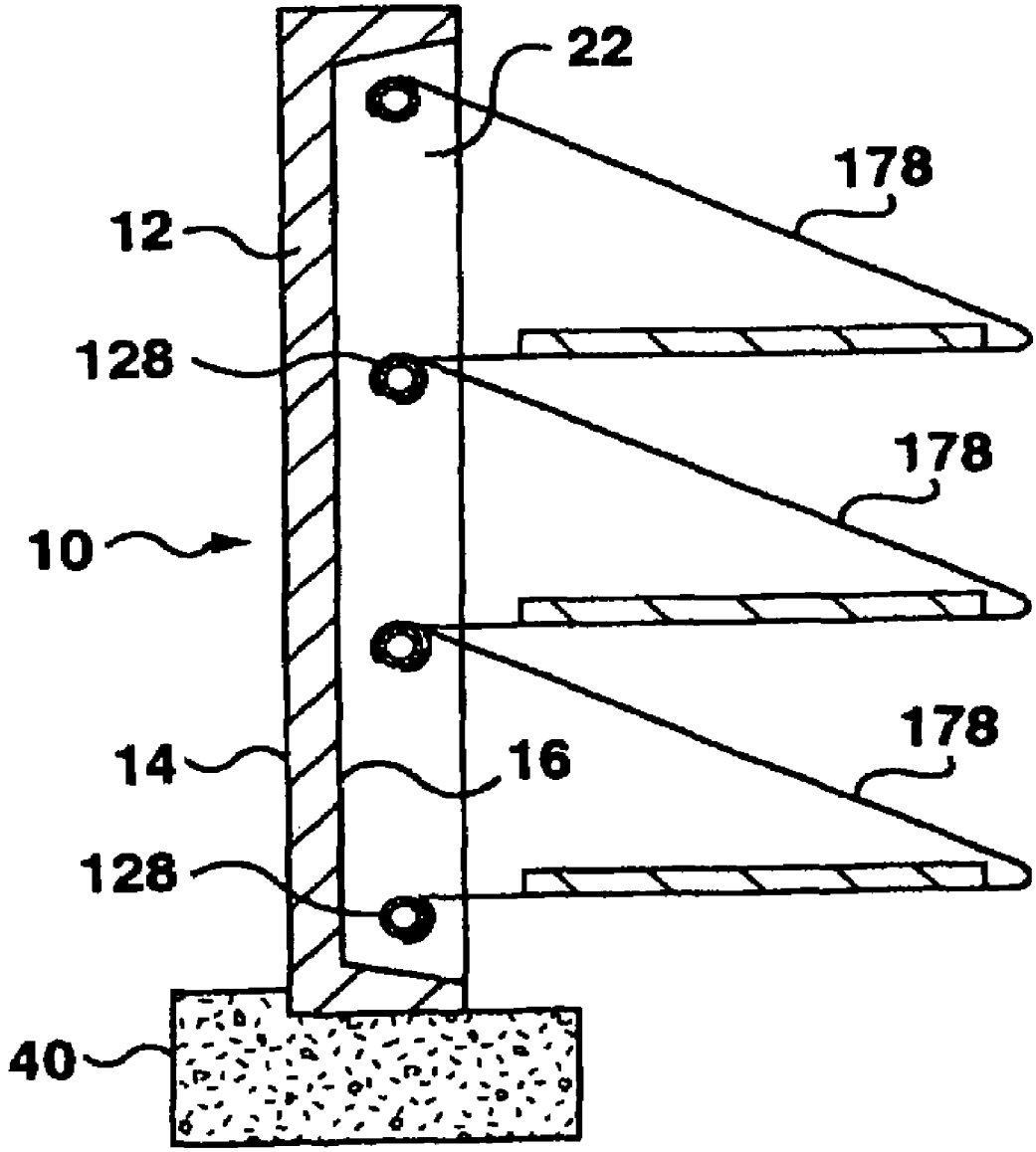
FIG. 29 is a schematic representation of a first panel used as a retaining wall.

FIG. 29 shows how the elongated pipes 128 can be used to install a first panel as a retaining wall. Brackets 178 are suspended from the elongated pipes 128 and extend behind the first panel 10. The brackets 178 support shelves 180 which span multiple brackets 178 of the same elevation. When earth or fill is backfilled against the inside face 16 of the first panel 10, the earth or fill is also piled on top of the shelves 180, starting from the lowest shelf 180. The weight of the earth or fill on the shelves 180 allows the first panel 10 to remain generally vertical after it is backfilled completely. A second panel 50 also fitted with brackets 178 and shelves 180 can be attached on top of the first panel 10 to build a retaining wall of greater height.

Methods of Making Concrete Panels and their Interior Structure

Figure 22:
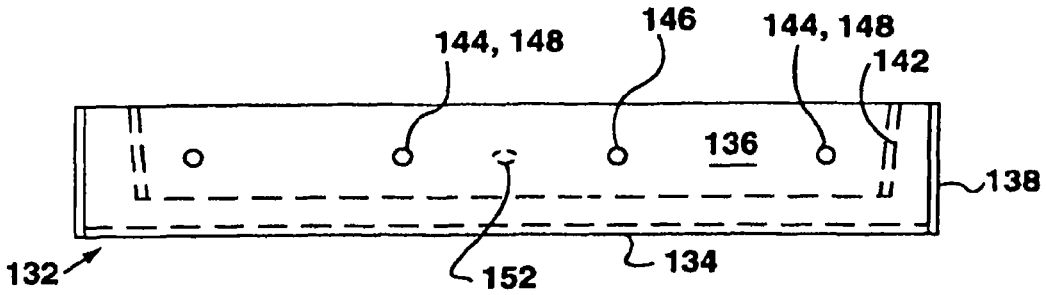
FIGS. 21 and 22 are elevation and plan views respectively of a form for making panels.
Figure 21:
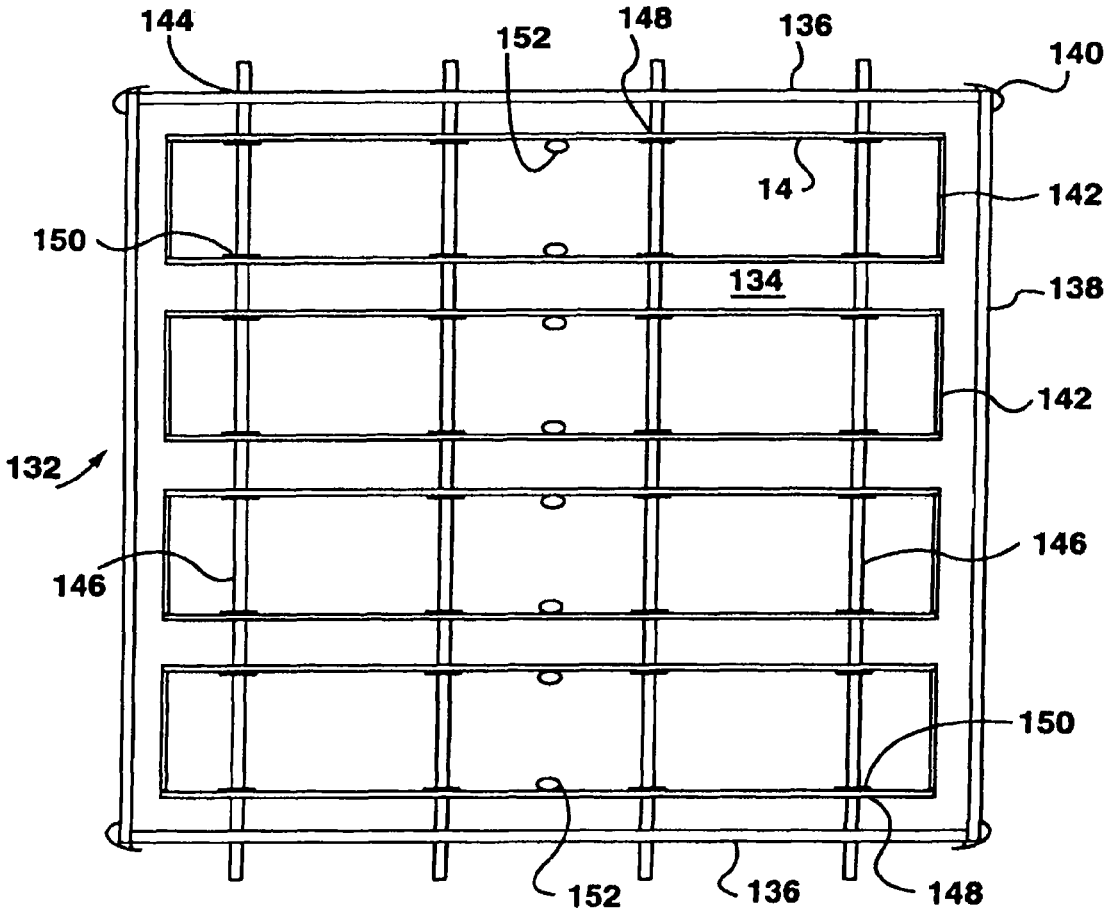

FIGS. 21 and 22 show a simplified form 132 for making first and second panels 10, 50. Various elements of the form 132, such as those needed to form major rabbets 26, minor rabbets 28, widened portions 30 or extensions 52, are not shown to better illustrate to following points.

The perimeter of the form 132 consists of a base 134, first sides 136 and second sides 138. For small runs, the base 134 and sides 136, 138 are preferably made of wood and nailed together with double headed nails for easier form stripping after a panel 10, 50 is made. For production runs, the base 134 and sides 136, 138 are preferably made of steel and attached with releasable clips 140. A plurality of sub-forms 142 define the interior edges of the beams 18, and ribs 22, 24. The sub-forms 142 are bottomless, however, and do not form the inside face 16 of the slab 12.

The first sides 136 are provided with side holes 144 spaced relative to the ribs 22, 24 so as to be concentric with the horizontal holes 32. A rod 146, typically a hollow steel pipe, has an outside diameter substantially equal to the diameter of the horizontal holes 32. The sub-forms 142 have sub form holes 148 which receive the rods 146 when the sub-forms 142 are in their proper position relative to the form 132. The rod 146 passes through the side holes 144 and sub-form holes 148 and extends across the form 132. Clamps 150 secure the sub-forms 142 in place laterally.

The sub-forms 142 are placed in the form 132 and the rods 146 are slid in place. The rods 146 act as a jig to quickly locate and hold the sub forms 142 in their proper place. Clamps 150 are secured. A layer of concrete to make the slab 12 is placed in the bottom of the form 132 (it can be poured through the sub-forms 142) and allowed to set somewhat so that it will not be substantially dislocated by later steps. More concrete is added to the form 132 to fill the spaces around the sub-forms 142. When the form 132 is filled, the concrete may vibrated as required and its exposed surface finished. Some special features, such as the return 88 shown in FIG. 11 may be formed after the remainder of a panel 10, 50 is complete.

The arrangement of the form 132 described above allows a textured base 134 to be used which applies an architectural finish to the outside face 14 of the slab 12. Alternatively, the sub-forms 142 can be inverted and positioned to contact the base 134. In this orientation, the outside face 14 of the slab 12 faces upwards and is exposed during forming. Such an exposed outside face 14 can be finished, for example, by texturing it or casting half bricks or tiles into it. In this orientation, the base 134 can also be made of a suitable sheet material with nails or other connectors protruding into the beams 20, 22 or ribs 22, 24. This sheet material remains a part of the panel 10, 50 after the concrete cures.

After the concrete cures, the form 132 is stripped, the components having previously been coated with release compound to make stripping easier. The rods 146 are removed by pulling them sideways out of the form 132. Because of the location and size of the rods 146, removing them automatically creates horizontal holes 32 where required. Vertical holes 38 are preferably also created during forming, for example by leaving sacrificial spacers in the form 132 as is known in the art. The sub-forms 142 have rings 152 which receive a cable from an overhead crane which pulls them out. The sub-forms 142 are preferably made of spring steel so that they flex away from the concrete when pulled to make stripping easier. The sides 136 and 138 are then separated from the base 134.

Optionally, the sub-forms 142 can be made of rigid foam insulation. In that case, the sub-forms 142 are not stripped and remain in the panel 10, 50 except as required to accommodate pipe bolts 92. Such foam sub-forms 142 are particularly useful when a return 88 (as shown in FIG. 11) will be formed in the panel 10, 50 since it allows the return 88 to be formed before the sub-forms are removed. Alternatively, an end rib 24 can be angled inwards without requiring complex collapsible forms. Such angled end ribs 24, or end ribs 24 angled outwards, provide another way of making corners in a wall. For example, two panels 10, 50 each with their end ribs 24 angled inwards by 45 degrees can be bolted together to make a 90 degree corner. This method is particularly useful however in making non-right angled corners as required, for example, for many bay windows. Further optionally, the rods 146 can be made of plastic pipes and left in the panel 10, 50 and later cut open as required.

The description above also applies to a third panel 60, but with some modifications. Before any concrete is poured or after the concrete for the slab 12 is poured, sub-forms 142 are located in the form 132 by rods 146 and clamps 150. Insulting blocks 64 are attached to the lower edges of the sides of the sub-forms 142. The insulting blocks 64 are cut or shaped as necessary to accommodate reinforcing material extending from the slab 12 of ribs 22, 24 or beams 18, 20 and provide passages 66 as discussed above. Additional material is also attached to the lower edges of the sides of the sub-forms 142 to temporarily fill the passages 66. This material will be removed later and is preferably a soft foam. Concrete for the slab 12 is then poured through the sub-forms 142 and vibrated in place. Concrete for the beams 18, 20 and ribs 22, 24 is then poured into the spaces between the sub-forms 142. After the concrete cures, the form 132 is stripped and the additional material removed. Inner sheets 70 may be added to the third panel 60 and attached to the insulating blocks 64 while the concrete is curing or after casting of the entire panel.

Figure 23:
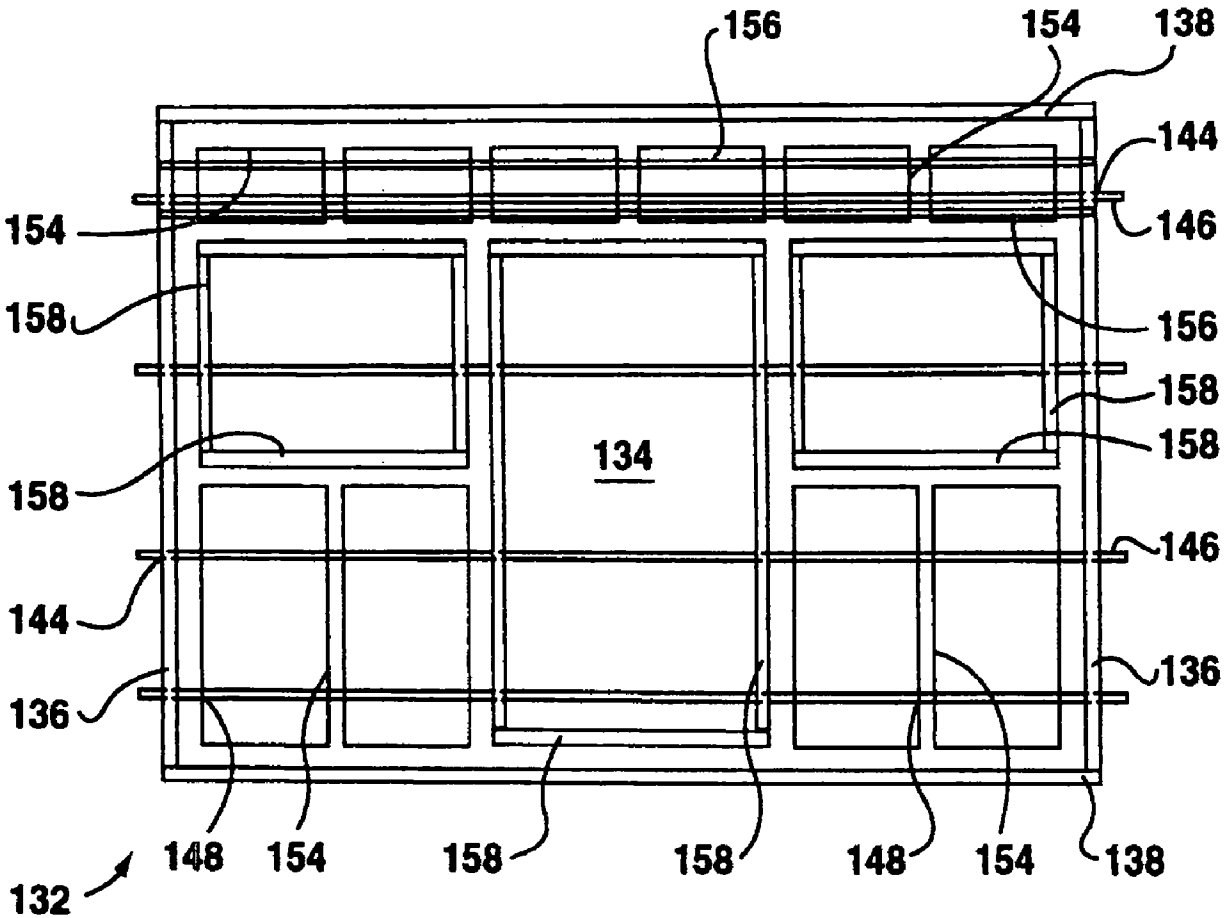
FIG. 23 is a plan view of a form for making panels with door or window openings.

FIG. 23 illustrates how the forming processes described above can be used to provide door or window openings into a panel 10, 50, 60. Modified sub-forms 154 are made to define the spaces in the panel 10, 50, 60 other than the spaces reserved for the door or window openings. Modified sub-forms 154 that will be support by only one rod 146 are kept level with strapping 156 placed across the first sides 136. Door or window bucks 158 are made to the required sizes and at a thickness that extends from the base 134 to the top of the form 132. The bucks 158 are typically made of dimensional lumber with screws or nails driven through them to protrude into the concrete of the beams 18, 20 or ribs 22, 24. Such bucks 158 remain in the panel 10, 50, 60 after it is made to provide the rough frame of a door or window. Alternatively, bucks 158 (without screws or nails driven through them) may be removed after the panel 10, 50, 60 is made.

Figure 24:
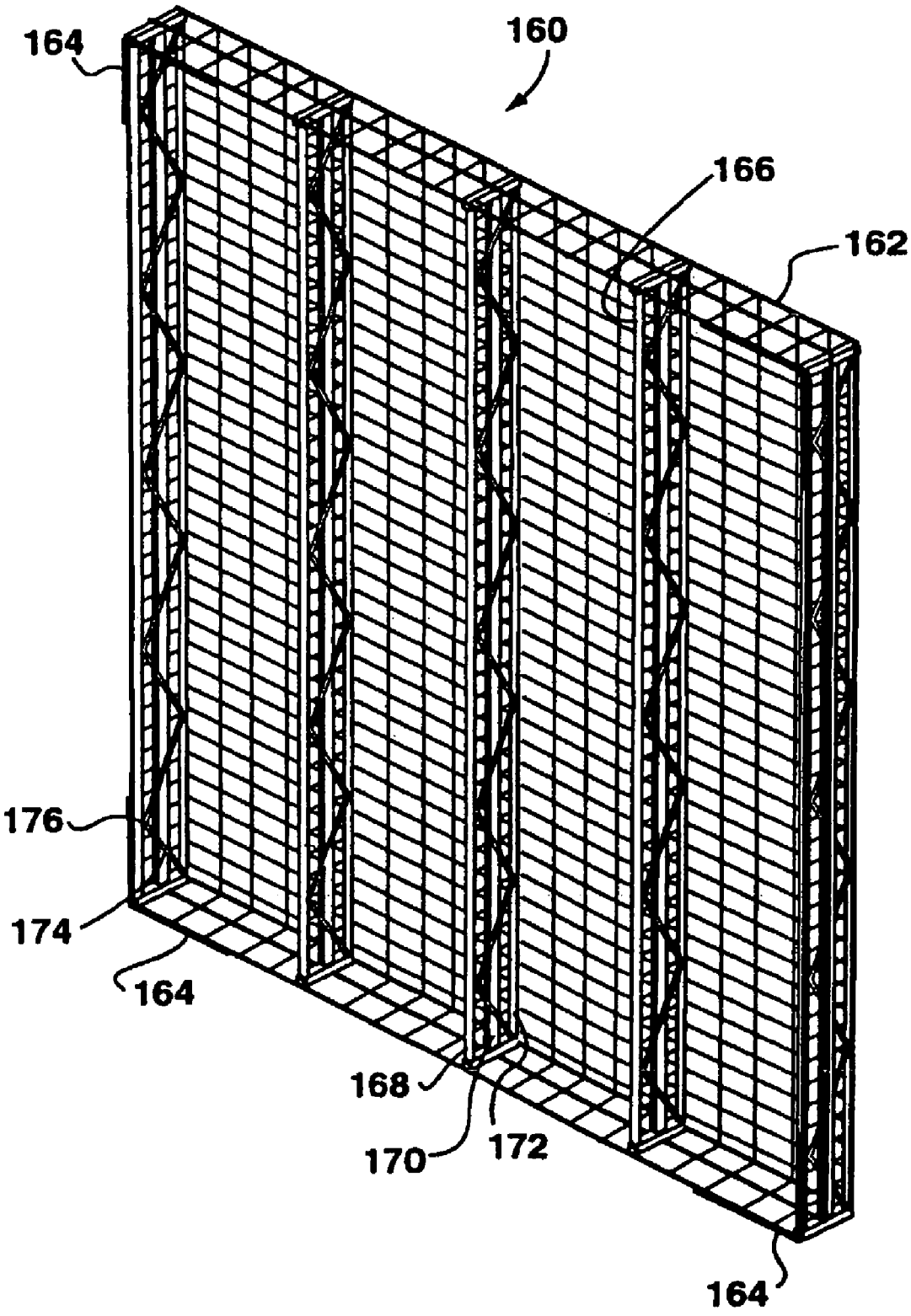
FIG. 24 is a perspective view of a basket of reinforcing material for a third panel.
Figure 28:
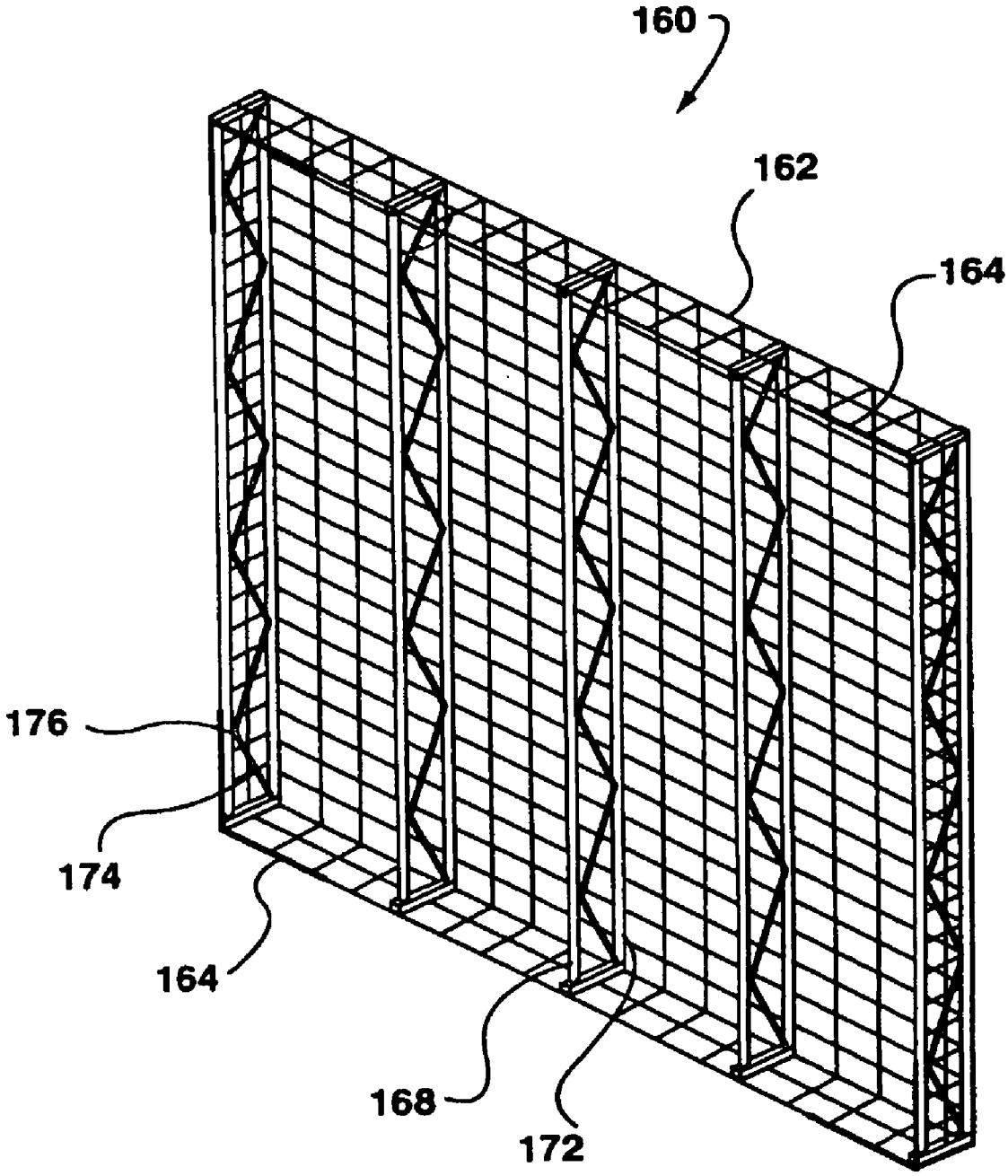
FIG. 28 is a perspective view of a basket of reinforcing material for a first or second panel.

As was mentioned above, the panels 10, 50, 60 are reinforced. Preferably, this reinforcing is pre-formed in a basket 160 as shown in FIGS. 24 and 28. FIG. 24 shows a basket 160 for an eight foot by ten foot third panel 60. FIG. 28 shows a basket for an eight foot square first or second panel 10, 50. The baskets 160 include a wire mesh 162 sized as required to reinforce the slab 12. The wire mesh 162 is bent upwards on all four sides to also provide reinforcement for the beams 18, 20 and end ribs 24. The corners of the basket 160 are reinforced by stiffening bars 164 as shown. Trusses 166 are provided to reinforce the ribs 22, 24 and located appropriately. Tie wires secure the various components of the basket 160 together. The basket is inserted into the form 132 prior to installing the sub-forms 142 or rods 146 or pouring any concrete. The basket is shimmed as required to locate is within the form 132.

Figure 25:
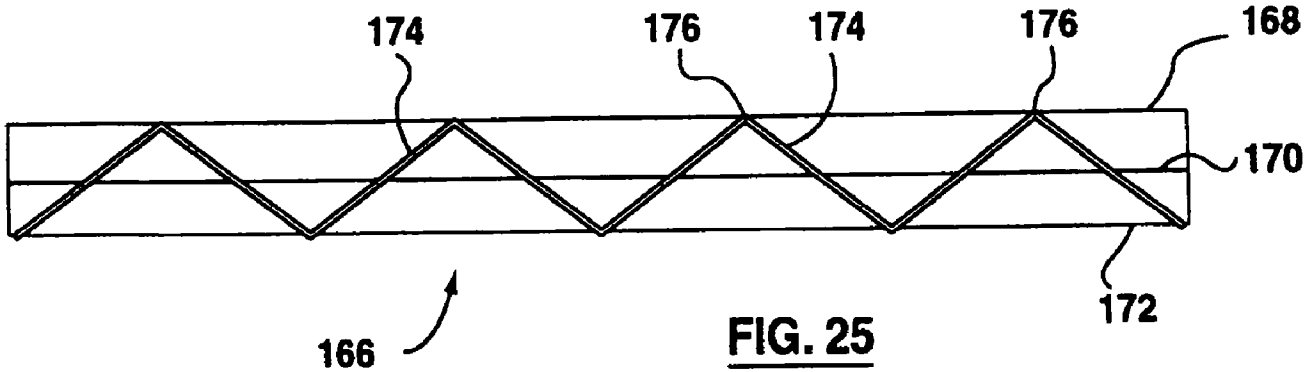
FIGS. 25, 26 and 27 are a reinforcing truss, a reinforcing truss installed in a rib of a first or second panel and a reinforcing truss installed in a rib of a third panel respectively.
Figure 27:
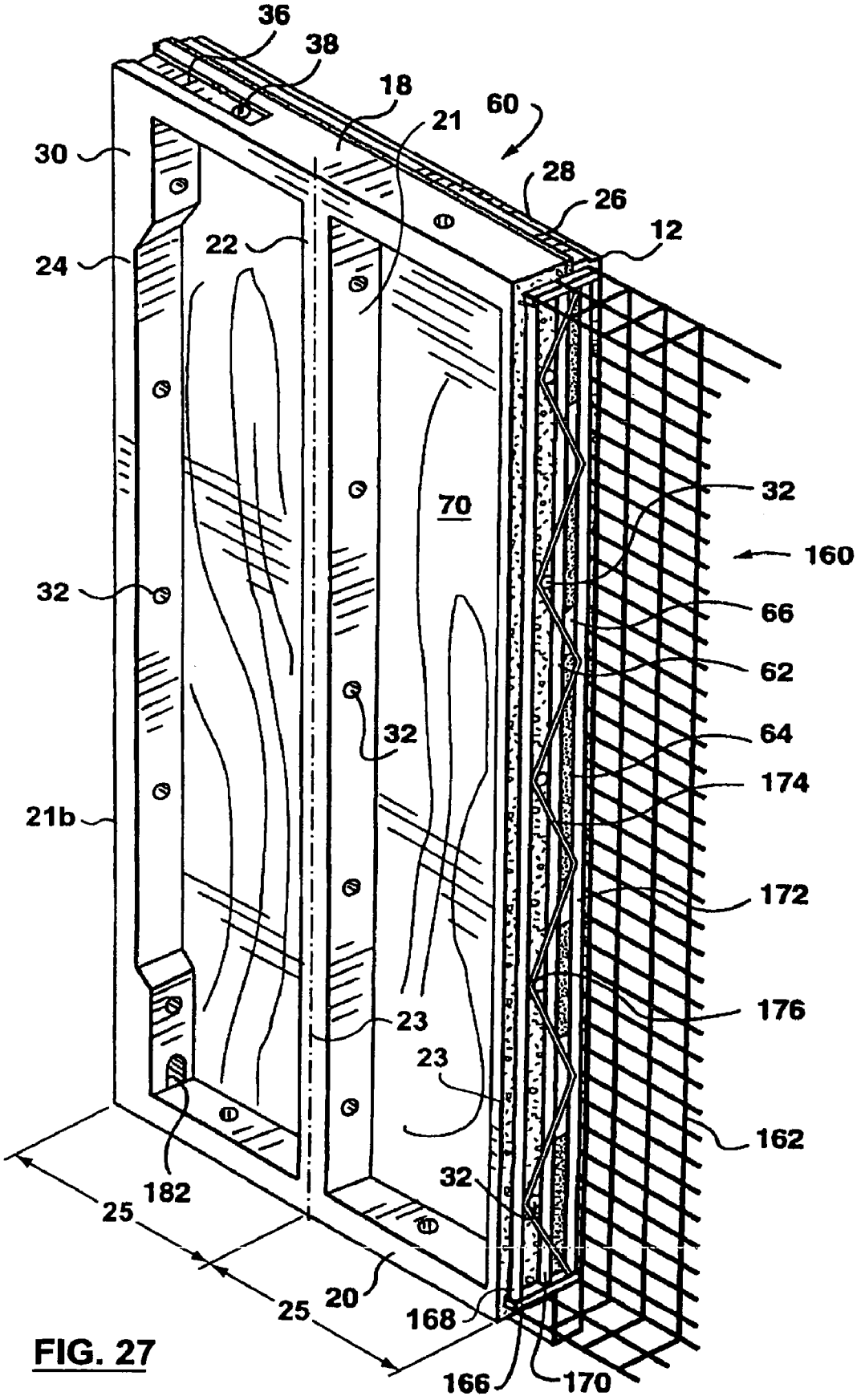

FIG. 25 shows a truss 166 for a third panel 60 in greater detail. The truss 166 has an upper cord 168, a mid cord 170 and a lower cord 172. Trusses for first and second panels 10, 50 are similar but the mid cord 170 may be omitted, as shown in FIG. 28. The lower cord 172 of the truss 166 is tied to the mesh 162 and accordingly is located in the slab 12 of a finished panel 10, 50, 60. The mid cord 170 and upper cord 168 are located in the ribs 22, 24 of a finished panel 10, 50, 60. In particular, as shown in FIGS. 9 and 27, the lower cord 168 or mid cord 170 and upper cord 172 contain the horizontal holes 32. In the third panel 60, the mid cord 170 is located outside of the air gap 62.

Figure 26:
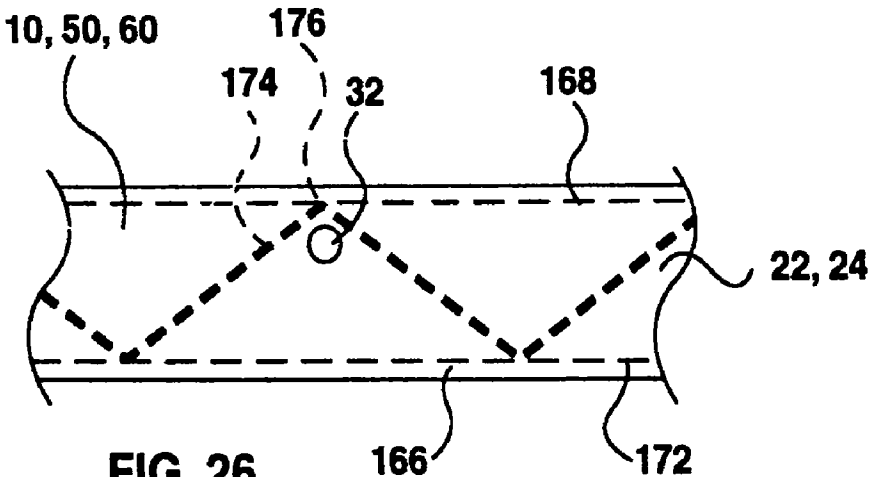

Diagonals 174 run across the cords 168, 170, 172 and are welded to them. Although the diagonals 174 may be distinct pieces, several diagonals 174 are typically made simultaneously by bending a piece of steel as required. The intersections 176 of the diagonals 174 at the upper cord 168 are spaced as described for the horizontal holes 32. Thus, as shown in FIGS. 26 and 27, the diagonals 174 further contain or surround the horizontal holes 32. This significantly reinforces the horizontal holes 32 and assists in making them strong enough to join adjacent panels 10, 50, 60 together or to support floors as shown in FIGS. 19 and 20. As shown in FIG. 27, the diagonals 174 of a third panel 60 also provide rigid, triangulated support for the slab 12 which assists in supporting the weight of the slab 12.

It is to be understood that what has been described are preferred embodiments of the invention. The invention nonetheless is susceptible to certain changes and alternative embodiments without departing from the subject invention, the scope of which is defined in the following claims.

I claim:

1. A wall system comprising, a) a plurality of concrete wall panels each panel comprising a slab having outside and inside faces, and a pair of end ribs connected to the slab, the ribs being oriented generally vertically when the panel is oriented generally vertically and provided on opposed ends of the panel, the plurality of panels comprising a first panel and a second panel adapted to be mounted above the first panel, the first panel comprising an upper surface and a rabbet formed in the upper surface opening to the outside face of the first panel and the second panel comprising a bottom surface and an extension extending from the bottom surface into the rabbet of the first panel;

b) a plurality of holes in the end ribs, the holes being provided in pairs, each pair comprised of a hole in each of the adjacent end ribs of adjacent panels, the holes of each pair positioned so as to permit a fastener to pass through the pair of holes; and, c) fasteners adapted to pass through the pairs of holes to secure adjacent panels together.

2. The wall system of claim 1 wherein the first panel further comprises an upper beam, the upper beam being oriented generally horizontally when the first panel is oriented generally vertically, the upper beam located at the top of the first panel and extending from the inside face of the first panel.

3. The wall system of claim 1, wherein the first panel further comprises a minor rabbet around some or all of the perimeter of the outside face, the minor rabbet opening towards the outside face of the first panel and adapted to receive a water infiltration resisting material.

4. The wall system of claim 1, wherein the rabbet is two-sided and is generally L-shaped.

5. The wall system of claim 1, wherein the extension on the second panel has a length that is greater than a depth of the rabbet on the first panel.

6. The wall system of claim 5, further comprising a floor deck inserted between the lower and upper panels, the extension on the second panel being longer than a thickness of the floor deck so that the extension can cover a vertical end face of the floor deck and extend into the rabbet of the first panel.

7. The wall system of claim 6, having a sheet disposed between the first panel and the second panel, the sheet extending from the rabbet on the first panel, past the end face of the floor deck toward an inside face of the second panel.

8. The wall system of claim 6, wherein an inside surface of the extension is spaced apart from the end face of the floor deck to provide an air gap therebetween.

9. The wall system of claim 1, wherein the second panel further comprises a second outside surface and a second inside surface and the extension includes a portion of the second outside surface.

10. The wall system of claim 1, wherein the rabbet is oriented generally horizontally when the first panel is oriented generally vertically.

11. A wall system comprising, a) a plurality of concrete wall panels each panel comprising a slab and a pair of end ribs connected to the slab, the ribs being oriented generally vertically when the panel is oriented generally vertically and provided on opposed ends of the pane, the plurality of concrete wall panels comprises a first panel comprising a first end rib having a first portion extending from the slab of the first panel and a second portion extending from the first portion in a direction towards the opposed end of the first panel;

b) a plurality of holes in the end ribs, the holes being provided in pairs, each pair comprised of a hole in each of the adjacent end ribs of adjacent panels, the holes of each pair positioned so as to permit a fastener to pass through the pair of holes, the holes in the first end rib being located in the second portion; and, c) fasteners adapted to pass through the pairs of holes to secure adjacent panels together.

12. A wall system comprising, a) a plurality of concrete wall panels each panel comprising a slab and a pair of end ribs connected to the slab, the ribs being oriented generally vertically when the panel is oriented generally vertically and provided on opposed ends of the panel;

b) a plurality of holes in the end ribs, the holes being provided in pairs, each pair comprised of a hole in each of the adjacent end ribs of adjacent panels, the holes of each pair positioned so as to permit a fastener to pass through the pair of holes;

c) fasteners adapted to pass through the pairs of holes to secure adjacent panels together; and, d) reinforcing bar in the end ribs, the reinforcing bar configured and located to surround the holes, wherein the reinforcing bar is configured to include generally triangular shapes and located such that apexes of the generally triangular shapes are located between the perimeter of the hole and the distal edge of the end ribs relative to the slab.

13. The wall system of claim 12 further comprising, d) a plurality of interior ribs positioned between the end ribs and connected to the slab;

e) a pair of side surfaces on each interior rib and end rib, the side surfaces being generally perpendicular to the slab and being oriented generally vertically when the panel is oriented generally vertically; and, f) a distal side surface of each end rib, the distal side surface being the one of the side surfaces of the end rib that is farther from any interior rib than the other side surface of the end rib, wherein, g) the spacing between the centerlines of adjacent interior ribs is substantially equal to a spacing interval;

h) for each end rib, the spacing between the distal side surface of the end rib and the centerline of an interior rib is substantially equal to the spacing interval; and, i) the spacing interval is a fraction of one of the standard length or standard width of a sheet material to be attached to the ribs of the concrete building panel, the fraction having a numerator of 1 and a denominator equal to a whole number.

14. The wall system of claim 12 wherein a first panel has an end rib mounted to the slab at an angle other than 90 degrees whereby a corner is produced when the first panel is attached to an adjacent panel having an end rib mounted to the slab at an angle of 90 degrees.

15. The wall system of claim 12 wherein a first panel has holes in the slab near one of the ends of the slab, the holes in the slab located to align with the holes in the end rib of an adjacent panel so as to permit a fastener to pass through pairs of holes, each pair of holes comprising a hole in the slab of the first panel and a hole in the end rib of an adjacent panel, such that the two panels may be bolted together to form a corner.

16. The wall system of claim 12 wherein the fasteners further comprise, (a) a hollow conduit;

(b) an abutment at one end of the hollow conduit to engage one of the concrete wall panels; and (c) an abutment at the other end of the hollow conduit to engage the other of the concrete wall panels, wherein the abutments do not completely block openings at the ends of the hollow conduit thereby permitting materials to pass through the conduit.

17. The wall system of claim 12 further comprising a tensioned cable passing through the holes of adjacent panels.

* * * * *